US005748838A

United States Patent [19]

Stevens

[11] Patent Number: 5,748,838

[45] Date of Patent: May 5, 1998

[54] METHOD OF SPEECH REPRESENTATION AND SYNTHESIS USING A SET OF HIGH LEVEL CONSTRAINED PARAMETERS

[75] Inventor: Kenneth N. Stevens, Cambridge, Mass.

[73] Assignee: Sensimetrics Corporation, Cambridge, Mass.

[21] Appl. No.: 708,271

[22] Filed: Aug. 22, 1996

Related U.S. Application Data

[63] Continuation of Ser. No. 366,398, Dec. 29, 1994, abandoned, which is a continuation of Ser. No. 765,926, Sep. 24, 1991, abandoned.

[51] Int. Cl.[6] ..... G10L 9/02

[52] U.S. Cl. ..... 395/2.7

[58] Field of Search ..... 395/2.7, 2.78, 395/2.79

[56] References Cited

U.S. PATENT DOCUMENTS

| | | | |
|---|---|---|---|
| 3,158,685 | 11/1964 | Gerstman et al. | 381/52 |
| 3,530,248 | 9/1970 | Coker | 381/53 |
| 3,908,085 | 9/1975 | Gagnon | 395/2.7 |
| 4,264,783 | 4/1981 | Gagnon | 395/2.7 |
| 4,754,485 | 6/1988 | Klatt . | |
| 4,829,573 | 5/1989 | Gagnon et al. | 395/2.7 |
| 5,097,511 | 3/1992 | Suda et al. | 395/2.7 |

OTHER PUBLICATIONS

Flanagan, Speech Analysis, Synthesis and Perception, Academic Press Inc, New York, 1965, pp. 21–33.

"Software for a cascade/parallel formant synthesizer" — Dennis H. Klatt, J. Acoust. Soc. Am. 67(3), Mar. 1980, pp. 971–995.

"Review of tex–to–speech conversion for English" —Dennis H. Klatt, J. Accoust. Soc. Am. 82(3), Sep. 1987, pp. 737–793.

"Constraints among parameters simplify control Klatt formant synthesizer" — Kenneth N. Stevens and Corine A. Bickley, Journal of Phonetics (1991) 19, pp. 161–174.

*Primary Examiner*—Allen R. MacDonald
*Assistant Examiner*—Susan Wieland
*Attorney, Agent, or Firm*—Hale and Dorr LLP

[57] ABSTRACT

A speech synthesizing method which uses glottal modelling to determine and transform ten or fewer high level parameters into thirty-nine low level parameters using mapping relations. These parameters are inputted to a speech synthesizer to enable speech to be synthesized more simply than with prior art systems that required 50 to 60 parameters to be inputted to represent any particular speech.

6 Claims, 11 Drawing Sheets

METHOD OF SPEECH REPRESENTATION AND SYNTHESIS USING A SET OF HIGH LEVEL CONSTRAINED PARAMETERS

This is a continuation of applications Ser. No. 08/366,398 filed on Dec. 29, 1994, now abandoned, which is a continuation of U.S. patent application Ser. No. 07/765,926 filed Sep. 24, 1991, now abandoned.

This invention relates generally to the field of representing and synthesizing speech and more specifically to a method of synthesizing speech using a synthesizer having as inputs a large number of relatively low level parameters. By the present invention, a small number of relatively high level, constrained parameters is used to determine the values of the larger number of low level parameters.

BACKGROUND OF THE INVENTION

Speech synthesis, the creation of artificial speech, is typically carried out by use of computer programs known as speech synthesizers. Such programs are important and widely used tools for the study of the production and perception of speech. In addition, speech synthesizers are components of devices capable of converting printed or stored symbolic text to audible speech, aiding individuals without sight. Speech synthesis is also used to develop methods of automatic speech recognition, permitting devices of various kinds to be controlled by spoken commands.

Two kinds of speech synthesizers have been the objects of considerable development effort: "articulatory," on the one hand; and "formant" or "terminal-analog" on the other. The former generally models the vocal tract as a physical entity, accepting articulator locations as inputs and calculating the acoustic output. The latter attempt to duplicate the linguistically significant acoustic events that are observed in speech waveforms, without regard to reproducing the mechanical aspects of how the waveform is made. The attributes of the acoustic events to be replicated are gleaned from examinations of graphic representations of speech waveforms (e.g., spectrograms, oscillograms), analysis-by-synthesis procedures, and from research on speech perception and production. Sufficient signal processing precision and knowledge of speech acoustics are incorporated into the controls for source and subsequent filtering components of modern terminal analog synthesizers to permit the generation of waveforms with characteristics very similar to those of natural speech waveforms.

In the articulatory synthesizer, the input data consist of a numerical description of the physical configuration of the vocal tract Mermelstein, P. (1973) Articulatory model for the study of speed production, J. Acoust. Soc. Am. 53, 1070–1082; Coker, C. H. (1976) A model of articulatory dynamics and control, Proc. IEEE 64, 452–459; Flanagan, J. L. & K. Ishizaka (1976) Automatic generation of voiceless excitation to a vocal cord-vocal tract speech synthesizer, IEEE Trans. Acoust. Speech and Signal Processing, ASSP-24, 163–170). The vocal tract is treated as an assembly of movable articulators, which include: the tongue body and tip; the velar opening to the nasal cavities; the lips; the laryngeal configuration; and the jaw, leading in its simplest realization to a set of about ten parameters. Using data from X-ray images of speech production, the timing and geometry of articulator movements are used to establish the three-dimensional spatial coordinates of key locations on each articulator and thus, appropriate values for the parameters. These values are used to compute the aerodynamic and acoustic properties of the vocal tract, and it is from these properties that a sampled speech synthesis waveform is calculated.

The quality of speech synthesized by the articulatory method is limited by various factors, including the complicated mathematical treatment required to transform the input parameters to a waveform. In addition, procurement of the data by X-ray necessarily exposes human subjects to undesirable radiation, limiting the amount of such data that can be obtained with safety. Although articulatory synthesizers theoretically require a relatively small amount of input information to generate speech, the results have until now only been satisfactorily intelligible or similar in sound to human speech for speech sounds requiring sustained vocal cord vibration (e.g. vowels, semi-vowels, glides and voiced stops).

The terminal-analog or formant synthesizer is based on an approach described by Fant and subsequently realized with considerable flexibility and precision by Klatt and others (Fant, G. (1959) Acoustic analysis and synthesis of speech with applications to Swedish, Ericsson Technics 15, 3–108; Holmes, J. N. (1973) The influence of the glottal waveform on the naturalness of speech from a parallel formant synthesizer, IEEE Transactions on Audio and Electroacoustics AU-21, 298–305; Klatt, D. H. (1980) Software for a cascade/parallel formant synthesizer, Journal of the Acoustical Society of America 67, 971–995). This type of synthesizer generates the wave components of the analog waveform that is produced by creating a sound source and using this source as input to a two terminal-pair network that simulates the filtering of sound by the vocal tract; hence the name terminal-analog. The acoustic source produces a waveform consisting of either noise or a sequence of pulses, and this forms the input to a succession of filters, principally in the form of simple resonators. The sources represent the generation of noise or periodic vibration at the glottis; the filters represent the effects on the sources of the various cavities and constrictions formed in the vocal tract by movement of the tongue, lips, jaw, and other articulators.

A large body of understanding of the properties of filters and network theory can be directly applied in the design of formant synthesizers. Typical input parameters include: the frequencies of formants or resonances of the vocal tract; the fundamental frequency of the glottal vibration; and the amplitude of the noise component. The most well known and fully developed terminal analog synthesizer has been developed by Dennis Klatt, and is described in Klatt, D. H., and Klatt, L. C. (1990) *Analysis, synthesis and perception of voice quality variations among female and male talkers*, Journal of the Acoustical Society of America, 87, 820–857, incorporated herein by reference. An earlier version is described at "Software for a cascade/parallel formant synthesizer," Klatt, D. H., Journal of the Acoustical Society of America 67, 971–995 (1980).

In the Klatt synthesizer, alterations in the modeled vocal tract are accomplished by changes in the values of some forty parameters, typically several hundred times per second of synthetic speech. The formant synthesizer has been developed to an extent that permits the automatic synthesis of speech from text or from a phoneme list at a natural speaking rate, with a high degree of intelligibility and a nearly human sound quality. Various terminal-analog synthesizers have been developed, each using a specific configuration of sources and filters and thus, each governed by its own set of parameters. Another is known as the Holmes parallel resonance synthesizer, and is described in Holmes, J. N. (1983) Formant synthesizers: cascade or parallel, Speech Communication 2, 251–273. Another synthesizer is the Infovox synthesizer, described in Carlson, R. and B. Granstrom (1976) A text-to-speech system based entirely on rules, Proc. Int. Conf. Acoust. Speech Signal Process. ICASSP-76, 686–688.

The formant synthesizer has certain attributes that make is especially useful in speech research. A principal advantage is that estimates of values for the parameters can, for the most part, be obtained directly from acoustic measurements of the various classes of speech sounds. In the case of vowels, for example, the fundamental frequency and formant frequencies and bandwidths can readily be obtained directly from spectral measurements, as can the spectral characteristics of aspiration and frication noise needed for synthesis of obstruents. Because the formant synthesizer allows a large number of acoustic parameters to be adjusted with great precision, it has found wide application in the creation of stimuli for use in studies of speech perception. It has also been useful in the analysis of speech, [in so-called "analysis by synthesis" methodologies] since the spectrum in a particular part of an utterance can readily be described in terms of the values of synthesis parameters required to generate a sound with such a spectrum.

While the use of the formant synthesizer in research, education and practical applications is preferred for the reasons cited above, the large number of parameters required to specify the changing source and filter properties places severe constraints on the ability of researchers to create and study synthetic speech. In the automatic synthesis of speech from text, simplifications are required leading to a degraded quality of the output speech. It is not unusual for an experienced speech technician to spend days in the synthesis of an utterance containing only a few words. Determination of the time varying values for all 40-some parameters for each speech sound is very difficult.

OBJECTS OF THE INVENTION

Thus, the several objects of the invention include providing a method of synthesizing speech which produces an analog signal very close to that of genuine human speech yet which does not require the determination of values for a large number of variable parameters. A further object of the invention is to provide a method of representing speech that requires a small set of variables, whose values are constrained within known limits. A further object of the invention is to provide a method of synthesizing and representing speech using variable parameters, the values of which can be determined or inferred from acoustic measurements without intrusively examining speakers, such as by using x-ray radiation.

SUMMARY OF THE INVENTION

A first preferred embodiment of the invention is a method for generating a signal corresponding to a sound sequence capable of being produced by a trachea and a vocal tract including a velopharyngeal port, a vocal fold, a glottal opening, and an intraoral cavity, said method comprising the steps of:

a. establishing a transformation between said sound sequence and each of a plurality of high level parameters selected from the group of:
   i. each of the first four natural frequencies of the vocal tract when the velopharyngeal port is closed and when there is no acoustic coupling between the vocal tract and the trachea;
   ii. the fundamental frequency of vocal fold vibration;
   iii. the area of glottal opening;
   iv. the area of narrowest vocal tract constriction for consonants;
   v. the cross-sectional area of the velopharyngeal port;
   vi. a stridency parameter measuring the effectiveness of noise generation due to obstacles to air flow in the vocal tract; and
   vii. the change in intraoral pressure for obstruent consonants as a consequence of change in vocal tract volume;
b. applying said transformation to said sound sequence to determine the value of each of said higher level parameters;
c. for selected aspects of said signal establishing an HL synthesizer correlation correlating said high level parameters to an aspect of said signal; and
d. applying said HL synthesizer correlation to said higher level parameters to generate said signal.

A second preferred embodiment of the invention is a method for use with a signal generator for generating a signal corresponding to a sound sequence capable of being produced by a trachea and a vocal tract including a velopharyngeal port, vocal folds, a glottal opening, and an intraoral cavity, said signal generated by establishing an LL synthesizer correlation between said signal and a plurality of relatively low level parameters, a method of determining the value of each of said plurality of low level parameters comprising the steps of:

a. establishing a parameter correlation between each of said plurality of lower level parameters, and a plurality of higher level parameters, said plurality of higher level parameters numbering fewer than said plurality of low level parameters, said higher level parameters selected from the group of:
   i. each of the first four natural frequencies of the vocal tract when the velopharyngeal port is closed and when there is no acoustic coupling between the vocal tract and the trachea;
   ii. the fundamental frequency of vocal fold vibration;
   iii. the area of glottal opening;
   iv. the area of narrowest vocal tract constriction for consonants;
   v. the cross-sectional area of the velopharyngeal port;
   vi. a stridency parameter measuring the effectiveness of noise generation due to obstacles to air flow in the vocal tract; and
   vii. the change in intraoral pressure for obstruent consonants as a consequence of change in vocal tract volume; and
b. applying said respective parameter correlation to said selected high level parameters to determine the values of each said low level parameter.

A third preferred embodiment of the invention is a method using cognates of the high level parameters specified above.

A fourth preferred embodiment of the invention is a method for specifying a sound sequence capable of being produced by a trachea and a vocal tract including a velopharyngeal port, a vocal fold, a glottal opening, and an intraoral cavity, said method comprising the steps of:

a. establishing a transformation between said sound sequence and each of a plurality of high level parameters selected from the group of:
   i. each of the first four natural frequencies of the vocal tract when the velopharyngeal port is closed and when there is no acoustic coupling between the vocal tract and the trachea;

ii. the fundamental frequency of vocal fold vibration;
iii. the area of glottal opening;
iv. the area of narrowest vocal tract constriction for consonants;
v. the cross-sectional area of the velopharyngeal port;
vi. a stridency parameter measuring the effectiveness of noise generation due to obstacles to air flow in the vocal tract; and
vii. the change in intraoral pressure for obstruent consonants as a consequence of change in vocal tract volume; and b. applying said transformation to said sound sequence to determine the value of each of said higher level parameters, thus specifying said sound sequence.

A fifth preferred embodiment of the invention is an apparatus for generating a signal corresponding to a sound sequence capable of being produced by a trachea and a vocal tract including a velopharyngeal port, a vocal fold, a glottal opening, and an intraoral cavity, said apparatus comprising:

a. means for establishing a transformation between said sound sequence and each of a plurality of high level parameters selected from the group of:
i. each of the first four natural frequencies of the vocal tract when the velopharyngeal port is closed and when there is no acoustic coupling between the vocal tract and the trachea;
ii. the fundamental frequency of vocal fold vibration;
iii. the area of glottal opening;
iv. the area of narrowest vocal tract constriction for consonants;
v. the cross-sectional area of the velopharyngeal port; and
vi. a stridency parameter measuring the effectiveness of noise generation due to obstacles to air flow in the vocal tract.
vii. the change in intraoral pressure for obstruent consonants as a consequence of change in vocal tract volume;

b. means for applying said transformation to said sound sequence to determine the value of each of said higher level parameters;

c. for selected aspects of said signal, means for establishing an HL synthesizer correlation correlating said high level parameters to an aspect of said signal; and d. means for applying said HL synthesizer correlation to said higher level parameters to generate said signal.

This invention simplifies the process of speech synthesis by reducing the number of parameters that need to be specified from nearly fifty to between nine and fifteen. The new method permits the synthesis of speech at least as natural and intelligible as has already been obtained with known synthesizers. The new parameters are designated "HL" (for High Level) parameters, to distinguish them from a larger number of Low Level (LL) parameters.

The use of a small set of HL parameters is possible due to acoustical and anatomical constraints that restrict the domain of combinations of LL parameters. These constraints, and the relations between LL parameters, are embodied in a set of mathematical equations, termed mapping relations, or parameter correlations which can be created for any terminal-analog or articulatory synthesizer and which relate HL parameters to LL parameters. Use of HL parameters, when combined with such a set of parameter correlations, allows a small number of HL input values to be used to create the complete specification of a sound sequence for a synthesizer that itself requires a large set of input parameters when operated by existing art. Further, use of HL parameters allows the development of a new generation of synthesizers, which will operate on fewer parameters.

Although a particular set of HL parameters is discussed, it will be understood that the invention may be implemented with other equivalent or cognate sets. For instance, the set described includes the parameters for the cross-sectional area of the glottal opening, the narrowest constriction in the vocal tract and the velopharyngeal port. Rather than using these area parameters, another set could use various volume pressures or various fluid flow rates to describe the vocal tract. Spatial parameters have been chosen because, based on present technology and understanding, they can be readily determined. However, as technology progresses it may be more convenient to express the set in terms of pressure, flow, or a combination of different parameters.

DETAILED DESCRIPTION OF THE PREFERRED EMBODIMENTS OF THE INVENTION

Figure 1:
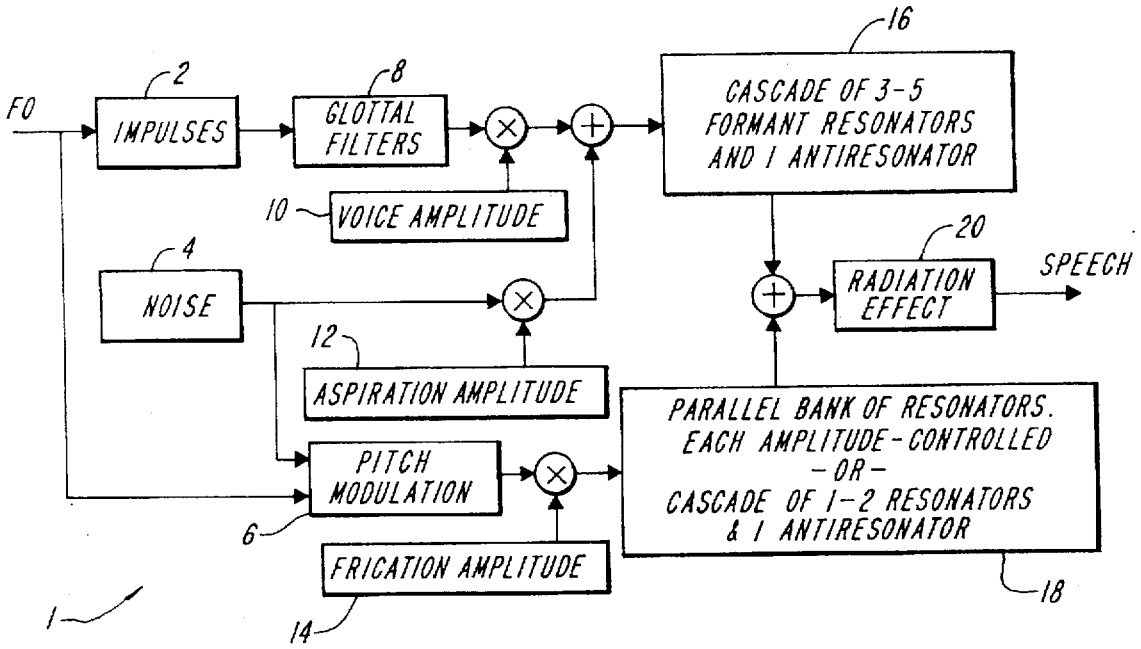
FIG. 1 (PRIOR ART)
FIG. 1 is a simplified block diagram of a formant synthesizer of the prior art.

The invention provides a system of high-level control for a synthesizer, such as a terminal-analog synthesizer, that simplifies the synthesis process and incorporates many of the constraints between low level parameters that are not captured in present versions of synthesizers. A set of 10 relatively higher-level control parameters is capable of generating most utterances or sound sequences. The actual control of the synthesizer is achieved by performing a transformation from the 10 higher-level parameters to, for instance 40-some lower-level parameters in a currently existing terminal-analog synthesizer—e.g. the KLSYN88 synthesizer identified above in Klatt & Klatt (1990). For convenience in describing the parameters and their relationships, the higher-level parameter set is referred to as the "HL" parameters. The lower level parameters for direct input to a synthesizer such as the KLSYN88 will be referred to as the "LL" parameters. The HL parameters will be identified with lower-case (e.g., fl, ac, an), and the LL parameters with capital letters (e.g., AV, FNP, A3).

A representative set of ten HL parameters are listed in Table I, together with a brief description of each parameter. Of the ten parameters, five are either identical to or similar to five of the existing LL parameters, and five are explicitly related to flows and pressures that can be set up in vocal tracts. These ten parameters provide very good results with respect to spoken English. Two or three more parameters may be added to control the generation of sounds with special articulatory attributes, such as lateral and retroflex consonants, or consonantal configurations with two narrow constrictions in the vocal tract, or to provide a more versatile control of the glottal source.

TABLE 1

HL Parameters.

| Parameter | Description |
|---|---|
| fl,f2,f3,f4, | First four natural frequencies of the vocal tract. These are the natural frequencies when the velopharyngeal port is closed, and when there is no acoustic coupling to the trachea. For non-nasal vowels with a glottal configuration appropriate for modal voicing, these natural frequencies are identical to the LL formant frequencies, F1, F2, F3, F4. |
| f0 | Fundamental frequency of vocal-fold vibration. This HL parameter is usually identical to the LL parameter F0. |
| ag | Area of glottal opening. Range is usually 0–0.4 $cm^2$. Average opening for modal voicing is usually about 0.03–0.05 $cm^2$. |
| ac | Area of narrowest vocal-tract constriction for consonants. Range is 0–0.4 $cm^2$. Does not apply for vowels for which narrowest opening is greater than 0.4 $cm^2$. |
| an | Cross-sectional area of velopharyngeal port. Range is 0–1.0 $cm^2$. |
| st | Stridency parameter, to be used when turbulence noise is generated with small ac. A measure of effectiveness of noise generation due to obstacles in the air stream. Range of variation is 10 dB (minimal noise, essentially no obstacle in airstream). |
| pm | Intraoral pressure increase or decrease for obstruent consonants as a consequence of active contraction or expansion of vocal-tract volume. The quantity pm is added to or subtracted from the intraoral pressure that would be obtained as a consequence of passive expansion of the vocal-tract surfaces during an obstruent consonant. It is expressed as a positive or negative fraction of the subglottal pressure Ps, and is usually in the range −0.5Ps to +0.2Ps. |

The first four HL parameters (f1, f2, f3, f4) are basically acoustic representations of the vocal-tract shape. Rather than describing the vocal-tract shape in spatial terms, such as tongue-body position, lip opening, jaw position, etc., as is done with an articulatory synthesizer, the vocal tract shape is represented by specifying the natural frequencies of the vocal tract. For purposes of specifying the necessary properties of the spoken sound, the acoustic description used in the present invention provides the same information as would an articulatory descriptive. Both are constrained to vary continuously with time. The acoustic description has the advantage that it can be measured directly (except as noted below), and includes the effect of compliant vocal-tract walls (Fant, 1972, Vocal tract wall effects, losses and resonance bandwidths, *Speech Transmission Laboratory Quarterly Progress and Status Report*, No. 4, 1–13).

It is important to note that f1, f2, f3 and f4 are the natural frequencies in the absence of acoustic coupling to a sidebranch, such as the trachea or to the nasal cavities. When a non-nasal vowel-like sound is being generated with modal vocal-fold vibration, these HL parameters have the same values as the LL parameters F1, F2, F3 and F4. When there is a velopharyngeal opening, the transformations from f1, f2, f3 and f4 to F1, F2, F3 and F4 must take this sidebranch coupling into account, following well-known theoretical principles of acoustics and aerodynamics. Further, one or more pole-zero pairs must be added to the KLSYN88 synthesizer transfer function. Fant, (1960), *Acoustic Theory of Speech Production*, The Hague: Mouton; Fujimura, (1962) Analysis of nasal consonants, *Journal of the Acoustical Society of America*, 34, 1865–1875; Fujimura, O. & Lindqvist, J. (1971), Sweep-tone measurements of vocal-tract characteristics, *Journal of the Acoustical Society of America*, 49, 541–548; Stevens, K. N., Fant, G. & Hawkins S., (1985), Some acoustical and perceptual correlates of nasal vowels, In, *In Honor of Ilse Lehiste: Ilse Lehiste Puhendusteos*; (R. Channon & L. Shockey, ed.), pp. 241–254. Dordecht: Foris Publications. If the glottal opening is large (greater than about 0.1 or 0.2 $cm^2$), there can be a shift of F1 in relation to f1, again based on well-known principles of acoustics and fluid flow (Fant, 1960).

The area of the glottal opening, ag, accounts for active abducting and adducting adjustments of the glottal opening. With appropriate adjustment of ag, various glottal configurations can be modeled, ranging from glottal closure to pressed voicing, modal voicing, breathy voicing, and aspiration noise with no glottal vibration. Associated with each glottal configuration, there are particular ranges of LL parameter values for the glottal model, particularly the open quotient (OQ), the tilt (TL) of the upper part of the spectrum (equivalent to the duration of the "return phase" in the model of Fant et al., 1985), and the amplitude of aspiration noise. Fant, G., Liljencrants, J. & Lin, Q. (1985) A four parameter model of glottal flow, *Speech Transmission Laboratory Quarterly Progress and Status Report*, Nos. 2–3, 28–52. These parameters can be estimated from models of sound generation at the glottis as discussed below in the examples.

Because the HL parameters are related to the normal speaking apparatus (e.g. vocal folds and velopharyngeal port), they can be used in the study of speech pathologies. They allow understanding of ways in which speech can be generated approximately by human speakers whose speaking apparatus differs from the norm.

The area of the vocal tract constriction ac is specified for consonants. For obstruent consonants, ac in combination with ag determines the airflow and the intraoral pressure (for a given subglottal pressure), and from these quantities (in combination with the stridency parameter st) it is possible to predict the amplitude (and spectrum) of the turbulence noise source at the constriction. Meyer-Eppler, W. (1953) Zum Erzeugungsmechanismus der Gerauschlaute, *Zeitschrift for Phonetik*, 7, 196–212; Shadle, C. (1985) The acoustics of fricative consonants, *Research Laboratory of Electronics Technical Report*, 506, Massachusetts Institute of Technology, Cambridge, Mass.; Stevens, K. (1971), Airflow and turbulence noise for fricative and stop consonants, *Journal of the Acoustical Society of America*, 50, 1180–1192; Badin, P. & Fant, G. (1989), Fricative production modeling: Aerodynamic and acoustic data, In *Proceedings, European conference on speech communication and technology, Eurospeech* 89, Paris, Vol. 2, pp. 23–26. All of these calculations are based on equations of flow and of aerodynamic noise generation. The location of the constriction in the vocal tract can be inferred from the pattern of natural frequencies based on data in the literature. Given this location and the turbulence noise source amplitude and spectrum, the transfer function from source to output can be estimated (Fant, 1960 (above)), and hence the LL parameters (AH, AF, AB, A2F–A6F and B2F–B6F) for noise filtering can be determined.

The area of the velopharyngeal opening, an, causes acoustic coupling to the nasal cavities, and, when ac is small, the velopharyngeal opening, an, prevents pressure buildup if it is sufficiently large. When f1, f2, f3, f4, ac and an are known, the locations of formants (F1, F2, F3, F4, F5, etc.) and of the nasal pole-zero pair (FNP, FNZ, BNP, BNZ) for the LL synthesizer can be determined for nasal vowels and for nasal consonants (for which ac=0). These mappings from HL to LL parameters for nasals are based on models that are reasonably well established, as noted above.

The parameters st and pm are invoked for obstruent consonants. The stridency parameter st accounts for the fact that the amplitude of a turbulence noise source for a given constriction size and airflow depends on the configuration of an obstacle or surface against which the airstream impinges (Shadle, 1985 (above)). For differently shaped or configured surfaces, it is estimated that there can be a range of 10 dB or more in the amplitude of the noise source.

The parameter pm accounts for the contribution of active expansion or contraction of the vocal-tract volume to the intraoral pressure for an obstruent consonant. M. Rothenberg (1968) The breath-stream dynamics of simple-released plosive production, Bibliotheca Phonetica 6, S. Karger, Basel). The specification of pm can be important for voiced obstruents.

The apparatus of the invention is designed to be used in conjunction with a speech synthesizer, either of the articulatory or the terminal-analog type. A simplified block diagram of a terminal-analog, or formant synthesizer is shown in FIG. 1.

Most terminal-analog synthesizers use a model similar to that shown in FIG. 1. The impulse source 2 generates a periodic train of impulses, useful to model voiced speech, where air is passed through the opening in the glottis, causing the glottis to vibrate. The noise source 4 generates pseudo-random noise, useful for modeling unvoiced speech where the glottis does not vibrate, and, if periodically shaped by pitch modulator 6, voiced fricatives. Glottal filters 8 are used to shape the glottal wave form, including tilting down the upper spectrum. Voice amplitude input 10 controls the amplitude of the impulse from source 2, corresponding roughly to the pressure across the glottis. Aspiration amplitude input 12 controls the amplitude of the noise from source 4, with respect to aspirated sounds, such as /$t^h$, $p^h$, $k^h$/. Frication amplitude input 14 controls the amplitude of frication, for example, between the upper teeth and the lower lip in forming an /f/ sound, or between the upper and lower lips in forming a /b/ sound.

For voiced speech without frication, the vocal tract is usually modeled as a cascade 16 of second order digital resonators, each representing a formant.

Figure 2A:
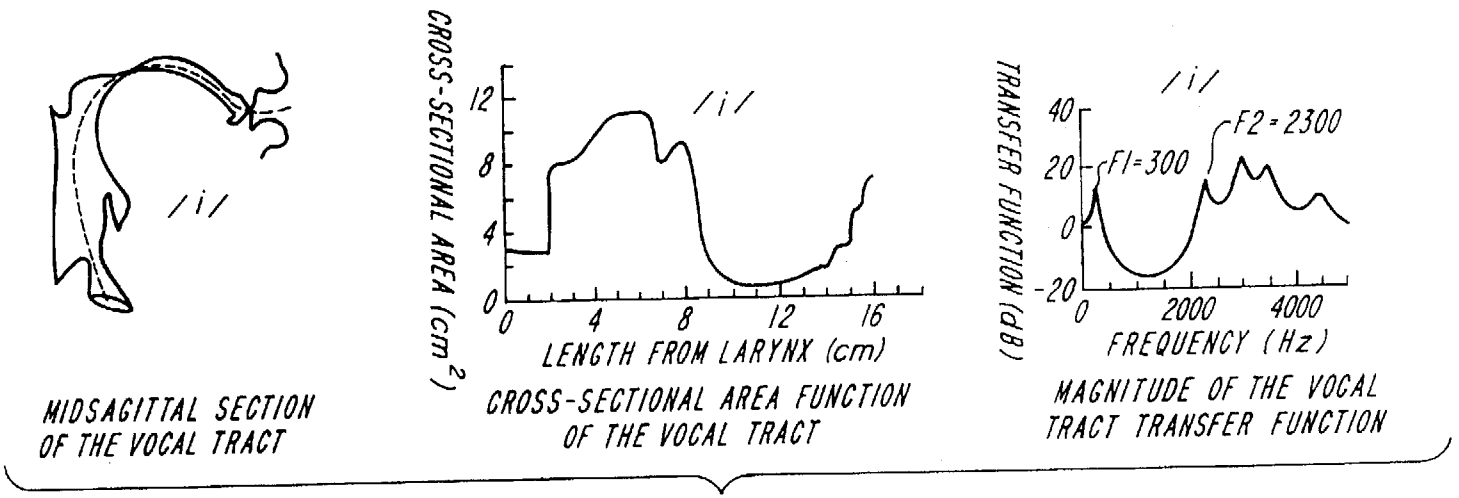
FIG. 2 shows schematically midsagittal views of the vocal tract, the acoustically relevant cross-sectional area of the vocal tract and frequency domain vocal tract transfer function for selected vowels.
Figure 2B:
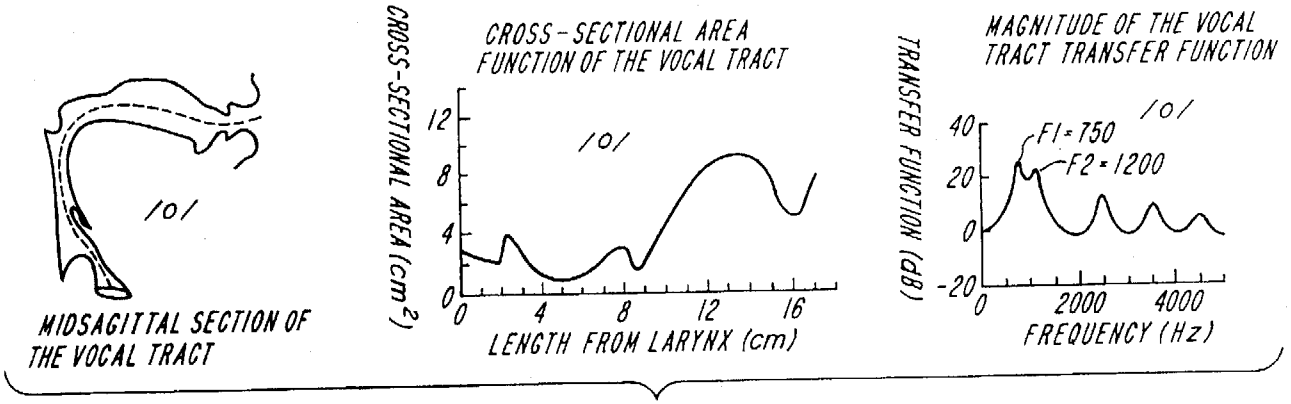
Figure 2C:
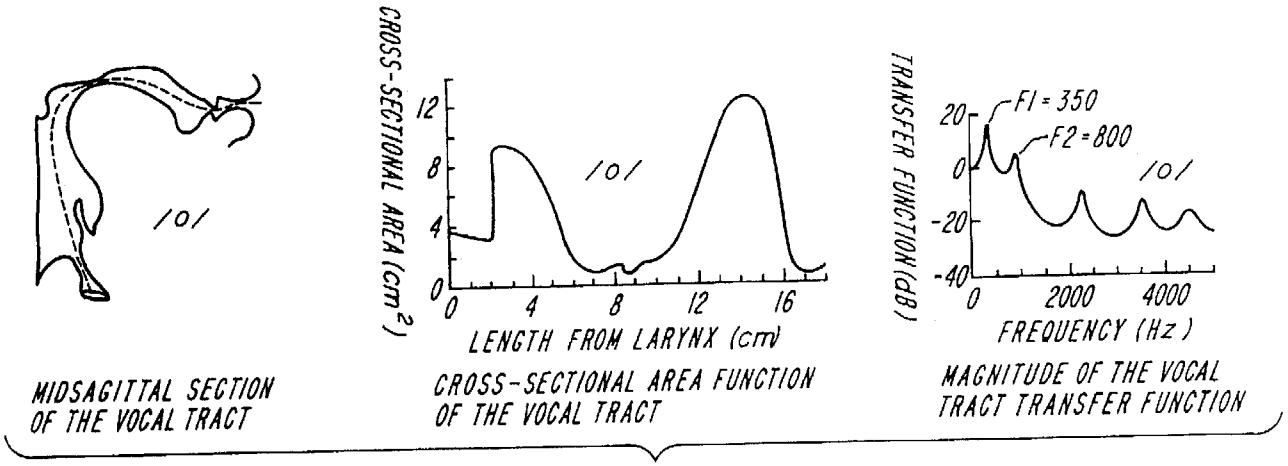

A "formant" is a frequency signified by a local peak in a transfer function. For instance, passage of an acoustic signal through a vocal tract results in a transformed signal. The transformed signal is related to the original input signal by a transfer function. FIG. 2 shows the spectral components of a transfer function for the vowel /u/ after the signal has passed through the vocal tract. Five distinct formants are evident in the transfer function, the first two being at 350 and 800 Hz respectively. Thus, the vocal tract will amplify that part of the signal at 350 Hz by an amount of approximately 18 dB and that part of the signal at 800 Hz by about 5 dB. That part of the signal at 2,200 Hz will be reduced by about 10 dB. As can be seen from FIG. 2, each formant is characterized by a frequency, amplitude and bandwidth. The resonators in cascade 16 are characterized by poles (corresponding to the formants), which contribute to the overall transfer function of the vocal tract. An antiresonator (zero) is also included in the series. This antiresonator is used in the synthesis of sounds in which there are side branches in the vocal tract, such as nasal sounds.

A second model 18 of the filtering effects of the vocal tract appears in the pathway for the synthesis of voiced fricatives. This second model 18 may use a cascade of several resonators (although generally fewer than are present with respect to the frication-free-voiced pathway) and an antiresonator or, alternatively, a bank of resonators in parallel, each having an independent amplitude control.

Finally, a radiation characteristic 20 models the effect of sound radiation from the lips and nose of a speaker.

Accordingly, to synthesize voiced phonemes, impulses from impulse source 2 pass through glottal filters 8 and are amplified at voice amplitude control 10 before passing through cascade 16 modeling the vocal tract. The output of the cascade passes through radiation characteristic 20 and then to an output device, such as a loudspeaker, not shown.

Similarly, to synthesize aspirated consonants, noise generated at noise source 4 is amplified at noise amplitude control 12, and then passes through the vocal tract cascade 16 as discussed above. The noise signal is summed with a voiced signal to produce mixed excitation having both voiced and aspirated components, such as a voiced /h/ sound.

To synthesize voiced fricatives, a noise signal from noise generator 4 and a fundamental frequency parameter F0 are applied to modulator 6 and amplified by frication amplitude control 14, before passing through the second vocal tract model 18 and passing to radiation characteristic 20 as described above. Synthesis of voiceless fricatives is done in the same way as for voiced fricatives, except that, since there is no voicing, no pitch modulation 6 occurs and the frication amplitude is not modulated.

Each of the components described above effects changes in the value of a parameter or set of parameters. In order to model a particular sound spoken by a particular vocal tract, values must be set for the parameters. Some of the parameters are constant over time for a particular vocal tract, or for a vocal tract under particular conditions, and others vary depending on the sound to be produced.

Figure 3:
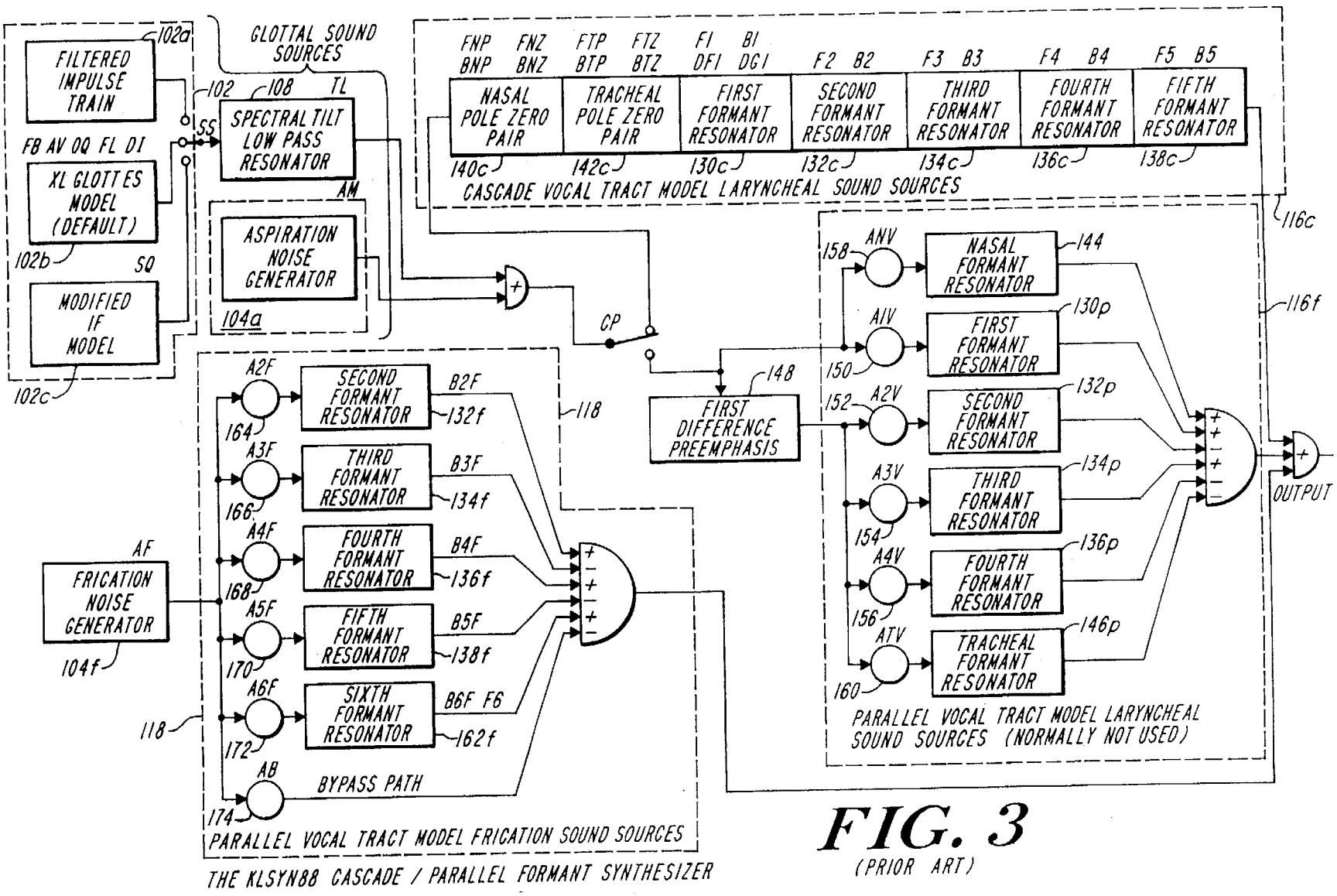
FIG. 3 (PRIOR ART)
FIG. 3 is a block diagram of a cascade-parallel formant synthesizer.

A more detailed implementation of a terminal analog synthesizer is shown schematically in FIG. 3. This is similar to the KLSYN88 cascade/parallel formant synthesizer, which is more fully described in Klatt and Klatt, 1990.

An impulse generator 102 models the vibration of the glottis as air is passed through its opening. The waveform characteristic generator 102 may include alternative methods for calculating waveform shapes such as 102*a*, 102*b* and 102*c*, each adapted for selected synthesis objectives. A spectral tilt low pass resonator 108 is provided for tilting the high frequency spectrum down by lowering the amplitudes of the higher frequencies.

The noise sources 104*a* and 104*f* model the generation of turbulence noise by the rapid flow of air past a narrow constriction. Turbulence noise arises whenever: 1) a constriction is small enough; or 2) and the pressure drop across the constriction is large enough that airflow becomes turbulent. The first phenomenon can be observed by forming the sound /f/, by starting with a large distance between the upper teeth and the lower lip, and then gradually decreasing the distance until it becomes small enough to generate turbulence. The second phenomenon can be observed by forming the same sound, keeping the teeth to lip distance constant, while increasing the air pressure from the lungs. In both cases, the vocal folds are spread apart so that the sound is not voiced and no constriction in the airway arises until the constriction due to the teeth and lip is reached.

Aspiration noise generator 104*a* simulates the noise generated at the glottis, such as with the phoneme /h/. Because the vocal cords are usually not set in vibration for this phoneme, it is not voiced. Frication noise generator 104*f* simulates the noise generated at other locations, such as the teeth and lips for /f/ or tongue and roof of mouth for /s/. The generation of plosives, such as /p/, /t/ and /k/ also consists primarily of frication noise generated by turbulence, having a step function at the leading edge of the signal due to the sudden release of oral pressure.

A first model 116*c* of the vocal tract filtering of laryngeal (glottal) sources is a cascade of resonators 130*c*, 132*c*, 134*c*, 136*c* and 138*c*, representing the first through fifth formants, respectively of the vocal tract. A tracheal pole/zero pair 142*c* is added to model tracheal resonances due to breathy phonation where the glottis is open over its posterior portion throughout the glottal cycle, such as for breathy vowels. An example of a breathy vowel is an /a/ following an /h/, such as /ha/.

A nasal pole/zero pair 140*c* is added to model nasal consonants, such as /m/, /n/ and nasalized vowels. For the production of both, the vocal tract is modeled as a resonating tube with an additional side-branch resonator. The zero occurs at a frequency where the side branch resonator causes an effective short circuit in the acoustic path from the glottis to the output. As a consequence, sound energy is reflected back to the source at this frequency, and does not appear at the output.

In general, a resonator, or pole, results in an amplifying effect on the transfer function for frequencies relatively near to the frequency of the pole. A typical maximum effect of a pole will be to increase the signal by 10–20 dB for the lowest two or three poles. A zero, or antiresonator will attenuate the portion of a signal corresponding to its frequency.

As an alternative to the cascade vocal tract model 116*c*, a parallel vocal tract model 116*p* can be used for laryngeal sound sources. In such a case, the same formant resonators are used for the first four resonators, 130*p*, 132*p*, 134*p*, 136*p*, having the same parameters as resonators 130*c*, 132*c*, 134*c* and 136*c*, respectively, as well as the nasal and tracheal resonators 144, 146. The values set for the frequency and bandwidth parameters of the parallel resonators are the same as the values set for the corresponding cascade resonators. Each resonator receives the same source input from the same source 148, modified by an independent amplitude control 150, 152, 154, 156, 158 and 160. The outputs are summed algebraically each with opposite signs.

Fricative consonants result from constrictions in the oral cavity which induce turbulent airflow, which in turn excites the vocal tract. Because the noise source is not at the larynx (beginning) portion of the vocal tract, a suitable transfer function includes zeroes in addition to poles. It has been found that a satisfactory approximation to the transfer function for frication excitation can be achieved without explicit specification of zeroes, using a set of parallel digital formant resonators having amplitude controls, as shown in frication vocal tract model 118. The transformation that would have been accomplished by zeroes is accounted for by appropriate settings of the formant amplitude controls 164, 166, 168, 170, 172 and 174. For example, if a formant would have been effectively cancelled by the presence of a nearby transfer-function zero, the amplitude of that formant is set to zero.

Only the second through fifth formants are required because the effect of the first formant is negligible in fricated speech. A sixth formant is added for high frequency noise, such as in /s/ and /z/. A bypass path is provided for those sounds having a flat vocal-tract transfer function, such as /f/ and /v/.

The formant frequency parameter values are the same as for the cascade series 116*c*. However, bandwidths differ due to losses present in the case of frication. Thus, separate bandwidth parameters e.g. B2F–B6F are indicated for vocal tract model 118, as compared to B1–B5 for the cascade model 116*c*.

Thus, as indicated in FIG. 3, a large number of parameters must be given values to control the synthesizer. As shown in FIG. 3, symbols for the variables appear in capital letters adjacent the block element representing the synthesizer component. For instance, for the nasal pole/zero pair 140*c*, the following must be specified: frequency nasal pole (FNP), frequency nasal zero (FNZ), bandwidth nasal pole (BNP) and bandwidth nasal zero (BNZ). For the third formant resonator 134*c*, frequency (F3) and bandwidth (B3) must be specified. These are the same parameters that must be specified for the third parallel formant resonator 134*p*, 134*f*. Third parallel frication resonator 134*f* uses the same frequency value (F3), but a different bandwidth (B3F).

Table 2 indicates the constant control or configuration parameters for the KLSYN88 synthesizer configuration. Each control parameter is assigned a two or three letter name, a minimum value, a default value, a maximum value, and a description of the effect on the synthesis. These parameters pertain to the signal processing aspects of the synthesizer and are set according to machine capacity, desired speed/accuracy tradeoff, etc.

TABLE 2

| | SYM | MIN | VAL | MAX | DESCRIPTION |
|---|---|---|---|---|---|
| 1. | DU | 30 | 500 | 5000 | Duration of the utterance, in msec |
| 2. | UI | 1 | 5 | 20 | Update interval for parameter reset, in msec |
| 3. | SR | 5000 | 10000 | 20000 | Output sampling rate, in samples/sec |
| 4. | NF | 1 | 5 | 6 | Number of formants in cascade branch |
| 5. | SS | 1 | 2 | 3 | Source switch |

TABLE 2-continued

| | SYM | MIN | VAL | MAX | DESCRIPTION |
|---|---|---|---|---|---|
| | | | | | (1=impulse, 2=natural, 3=LF model) |
| 6. | RS | 1 | 8 | 8191 | Random seed (initial value of random number generator) |
| 7. | SB | 0 | 1 | 1 | Same noise burst, reset RS if AF=0 and AH=0 (0=no, 1=yes) |
| 8. | CP | 0 | 0 | 1 | 0 implies Cascade, 1 implies parallel tract excitation by AV |
| 9. | OS | 0 | 0 | 20 | Output selector (0=normai, 1=voicing source, . . .) |
| 10. | GV | 0 | 60 | 80 | Overall gain scale factor for AV, in dB |
| 11. | GH | 0 | 60 | 80 | Overall gain scale factor for AH, in dB |
| 12. | GF | 0 | 60 | 80 | Overall gain scale factor for AF, in dB |

Table 3 indicates the variable control parameters that can be varied over time in the KLSYN88 synthesizer configuration, showing the same type of information as Table 2. The two or three letter symbol names are used in FIG. 3.

TABLE 3

| | SYM | MIN | VAL | MAX | DESCRIPTION |
|---|---|---|---|---|---|
| 13. | F0 | 0 | 1000 | 5000 | Fundamental frequency, in tenths of a Hz |
| 14. | AV | 0 | 60 | 80 | Amplitude of voicing, in dB |
| 15. | OQ | 10 | 50 | 99 | Open quotient (voicing open-time/period), in % |
| 16. | SQ | 100 | 200 | 500 | Speed quotient (rise/fall time of open period, LF model), in % |
| 17. | TL | 0 | 0 | 41 | Extra tilt of voicing spectrum, dB down @3 kHz |
| 18. | FL | 0 | 0 | 100 | Flutter (random fluctuation in f0), in % of maximum |
| 19. | DI | 0 | 0 | 100 | Diplophonia (pairs of periods migrate together), in % of max |
| 20. | AH | 0 | 0 | 80 | Amplitude of aspiration, in dB |
| 21. | AF | 0 | 0 | 80 | Amplitude of frication, in dB |
| 22. | F1 | 180 | 500 | 1300 | Frequency of the lst formant, in Hz |
| 23. | B1 | 30 | 60 | 1000 | Bandwidth of the lst format, in Hz |
| 24. | DF1 | 0 | 0 | 100 | Change in F1 during open portion of a period, in Hz |
| 25. | DB1 | 0 | 0 | 400 | Change in B1 during open portion of a period, in Hz |
| 26. | F2 | 550 | 1500 | 3000 | Frequency of the 2nd format, in Hz |
| 27. | B2 | 40 | 90 | 1000 | Bandwidth of the 2nd format, in Hz |
| 28. | F3 | 1200 | 2500 | 4800 | Frequency of the 3rd format, in Hz |
| 29. | B3 | 60 | 150 | 1000 | Bandwidth of the 3rd formant, in Hz |
| 30. | F4 | 2400 | 3250 | 4990 | Frequency of the 4th formant, in Hz |
| 31. | B4 | 100 | 200 | 1000 | Bandwidth of the 4th formant, in Hz |
| 32. | F5 | 3000 | 3700 | 4990 | Frequency of the 5th formant, in Hz |
| 33. | B5 | 100 | 200 | 1500 | Bandwidth of the 5th formant in Hz |
| 34. | F6 | 3000 | 4990 | 4990 | Frequency of the 6th formant, in Hz (frication or if NF=6) |
| 35. | B6 | 100 | 500 | 4000 | Bandwidth of the 6th formant in Hz (only applies if NF=6) |
| 36. | FNP | 180 | 280 | 500 | Frequency of the nasal pole, in Hz |
| 37. | BNP | 40 | 90 | 1000 | Bandwidth of the nasal pole, in Hz |
| 38. | FNZ | 180 | 280 | 800 | Frequency of the nasal zero, in Hz |
| 39. | BNZ | 40 | 90 | 1000 | Frequency of the nasal zero, in HZ |
| 40. | FTP | 300 | 2150 | 3000 | Frequency of the tracheal pole, in Hz |
| 41. | BTP | 40 | 180 | 1000 | Bandwidth of the tracheal pole, in Hz |
| 42. | FTZ | 300 | 2150 | 3000 | Frequency of the tracheal zero, in Hz |
| 43. | BTZ | 40 | 180 | 2000 | Bandwidth of the tracheal zero, in Hz |
| 44. | A2F | 0 | 0 | 80 | Amplitude of frication-excited parallel 2nd formant, in dB |
| 45. | A3F | 0 | 0 | 80 | Amplitude of frication-excited parallel 3rd formant in dB |
| 46. | A4F | 0 | 0 | 80 | Amplitude of frication-excited parallel 4th formant, in dB |
| 47. | A5F | 0 | 0 | 80 | Amplitude of frication-excited parallel 5th formant, in dB |
| 48. | A6F | 0 | 0 | 80 | Amplitude of frication-excited parallel 6th formant, in dB |
| 49. | AB | 0 | 0 | 80 | Amplitude of frication-excited parallel bypass path, in dB |
| 50. | B2F | 40 | 250 | 1000 | Bandwidth of frication-excited parallel 2nd formant, in Hz |
| 51. | B3F | 60 | 320 | 1000 | Bandwidth of frication-excited parallel 3rd formant, in Hz |
| 52. | B4F | 100 | 350 | 1000 | Bandwidth of frication-excited parallel 4th formant, in Hz |
| 53. | B5F | 100 | 500 | 1500 | Bandwidth of frication-excited parallel 5th formant, in Hz |
| 54. | B6F | 100 | 1500 | 4000 | Bandwidth of frication-excited parallel 6th formant, in Hz |

Other variable parameters can be added in order to conduct experiments in speech synthesis; however, they are not necessary for basic synthesis. These include amplitude of voicing-excited parallel nasal, tracheal and 1st–4th formants.

The invention can be used in conjunction with a terminal-analogue synthesizer such as is discussed above. To set up the synthesizer, a user first decides on certain voice characteristics to be used for synthesizing an utterance or sound sequence. These are entered into the synthesizer as constant parameters. Having selected an utterance to be produced, the user then estimates how the HL parameters are to be manipulated in order to synthesize the utterance. One way of estimating the HL parameters is to perform an acoustic analysis of an example of the utterance, and, together with information available in technical publications, to infer the time-varying values of the parameters. Another way is to assemble a set of transformation rules for translating from the known sequence of sounds and words into the HL parameters. Examples of HL parameters for several sequences of speech sounds are given in the following section.

Figure 4:
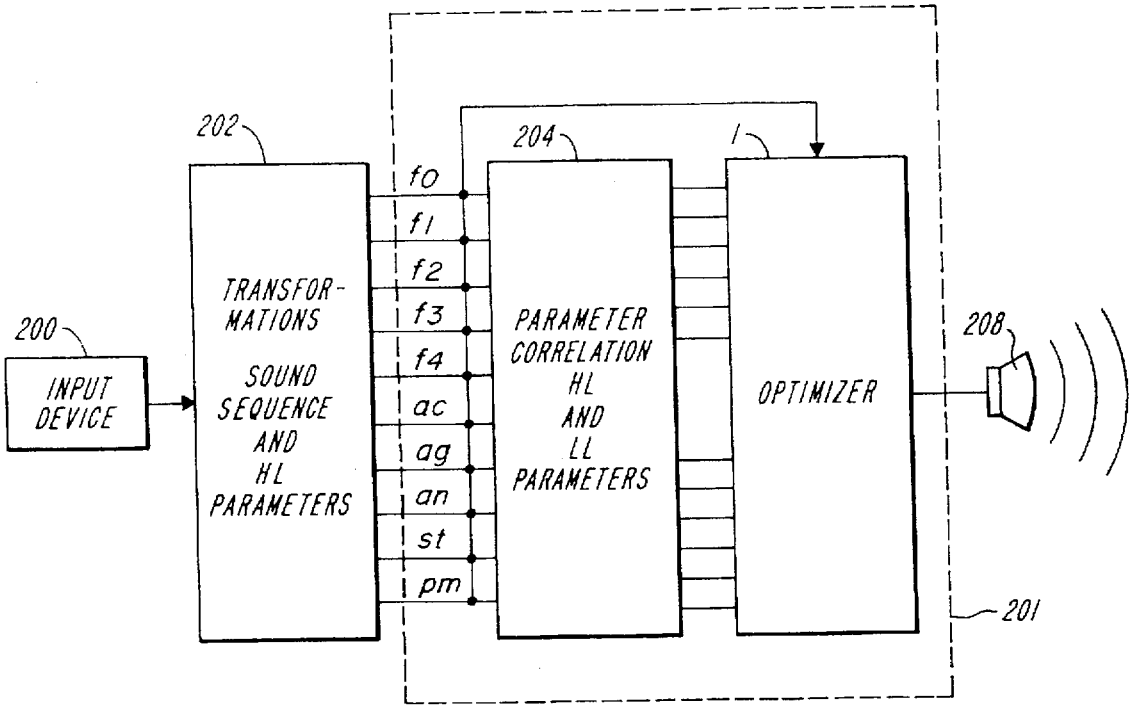
FIG. 4 is a block diagram of an apparatus that includes means for representing speech using both HL and LL parameters.

If a set of rules are assembled, then the apparatus of the invention, shown schematically in FIG. 4, can be used. The user inputs the utterance or sound sequence into the apparatus through input device 200. The input device may be a microphone, keyboard, or other suitable device. Means 202 are provided for transforming the sound sequence into HL parameters according to the set of rules established. Means 202 may be a properly programmed general purpose digital computer. The program may use rules or tables for transforming the sound sequences into an array of HL parameters. As used herein, the rules relating sound sequences to HL parameters are referred to as "transformations".

The array of HL parameters is shown as inputs to correlator 204 in FIG. 4. Corellator 204 correlates HL parameter values to LL parameter values, according to certain mapping rules, also referred to in the claims as "parameter correlations". For each LL parameter, corellator 204 includes a mapping relation, mapping each HL parameter to a set of LL parameters. A given set of values for HL input parameters produces a determinable set of values for LL parameters. These determined LL parameter values are the inputs to a synthesizer 1, of the type discussed above. The inputs include values for all of the types of parameters set forth in Tables 2 and 3. The synthesizer 1 takes the inputs and computes values for an acoustic waveform. The synthesizer can also be considered to apply a correlation to the LL parameters, to arrive at the acoustic wavefrom. As used herein, and in the claims, the term "LL synthesizer correlation" refers to such a correlation.

The output of the synthesizer is an analog signal, that may be broadcast through speaker 208. Alternatively, the signal may be stored, transmitted to another site, or converted, for instance, into digital form.

It may also be possible to bypass correlation means 204 altogether, if synthesizer 1 is designed to take HL parameters as inputs. In such a case, the correlation is referred to herein and in the specification as an "HL synthesizer correlation". It is also possible to model such a situation as one where the functions performed by parametic correlation means and synthesizer 1 are performed by an augmented synthesizer 201, as indicated by the box shown in dotted outline.

Deriving LL parameters from HL parameters

From the following discussion, one of ordinary skill in the art will understand in general how to establish mapping rules between HL and LL parameters.

Figure 5A:
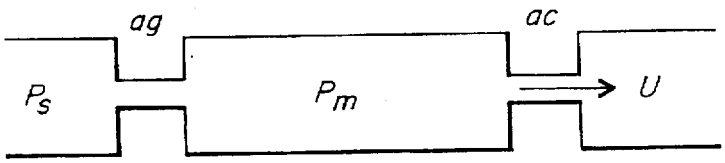
FIG. 5*a* is a schematic representation of a model of a vocal tract, identifying some HL parameters and some intermediate parameters.
Figure 5B:
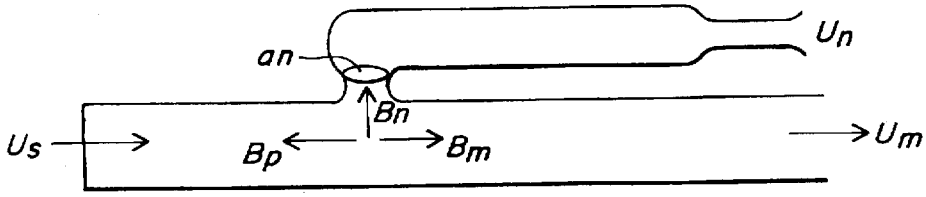
FIG. 5*b* is a schematic representation of a model of a vocal tract including the nasal passage.

FIG. 5*a* shows a model for an idealized, simplified vocal tract without coupling to the nasal cavity, and identifies two HL parameters: ag (area of glottal opening) and ac (area of vocal tract constriction). FIG. 5*b* shows an idealized model in which there is coupling through an opening (the velopharyngeal port) to the nasal cavity. The cross-sectional area of the velopharyngeal port is HL parameter an.

Three of the high-level parameters describe areas of openings: the glottal opening (ag); the narrowest constriction along the vocal tract (ac); and the cross-section of the velopharyngeal port (an). The mapping between HL and LL parameters can be conveniently determined in terms of three intermediate parameters: the air flow through the glottal constriction (Ug), the air flow through the oral constriction (Uc), and the intra-oral pressure (Pm). In order to calculate the intermediate parameters Ug, Uc and Pm, an electrical circuit model of the vocal tract can be used.

Figure 6:
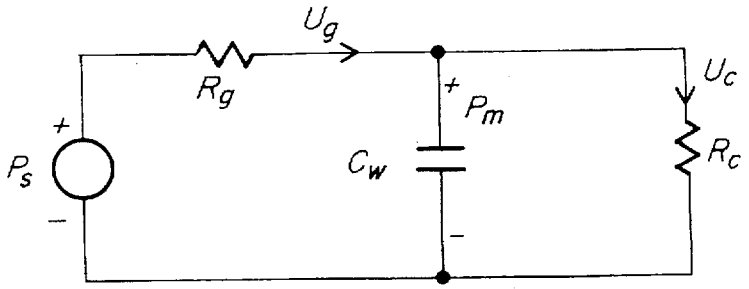
FIG. 6 shows an electrical circuit used to analyze some aspects of the behavior of the vocal tract model of FIG. 5*a*.

As shown schematically in FIG. 6, the subglottal pressure source is modeled as a voltage source Ps. The resistance at the glottis and at the vocal tract constriction are modeled as resistances Rg and Rc respectively. The compliance of the vocal tract walls is modeled as a capacitance Cw. Ug and Uc correspond to the flow of air through the glottis and a constriction, respectively, and are modeled as current flows. The voltage drop Pm across capacitance Cw models the pressure inside the vocal tract.

From this model three equations in terms of the three unknown intermediate parameters Ug, Uc, and Pm can be written. Those equations are $$Ug = Cw\frac{dPm}{dt} + Uc$$

$$RcUc = Pm$$

$$Ps = RgUg + RcUc$$

Where $$Rg = \frac{rUg}{2(ag)^2} \text{ and } Rc = \frac{rUc}{2(ac)^2}$$

Replacing derivatives by differences results in three discrete equations:

$$\frac{Cw\,Pm}{deltat} - Ug + Uc = \frac{Cw\,Pm(\text{previous})}{\text{delta} - \text{t}} \quad (1)$$

$$-Pm + \frac{rUc^2}{2(ac)^2} = 0 \quad (2)$$

$$\frac{rUg^2}{2(ag)^2} + \frac{rUc^2}{2(ac)^2} = Ps \quad (3)$$

Where r=0.00114 gm/cm$^3$ and Cw=2×10$^{-4}$ cm$^5$/dyne. A suggested value for delta-t is 4×10$^{-5}$ sec.

This system of non-linear equations can be solved numerically for Ug, Uc, and Pm by well-known techniques such as Newton's method (Strang, G. (1986) Introduction to Applied Mathematics, Wellesley-Cambridge Press, Wellesley Mass., p. 373). For a given set of values for Ug, Uc, Ps, and Pm, the LL parameters AF, AH and AV can be calculated.

For instance the ratio of the areas of the glottal opening and the oral constriction determine the ratio of the intra-oral pressure Pm to the subglottal pressure (Ps). Estimates of subglottal pressure are readily available in the literature; a value of 8 cm $H_2O$ is typical for an adult speaker. Then, the intra-oral pressure Pm can be used to estimate the low-level parameter AH (amplitude of aspiration noise) by the formula:

$$AH = 20 \log [(Ps-Pm)^{3/2} \times ag^{1/2}] + Ka \quad (4)$$

which is based on models of turbulence noise generation at a constriction (Stevens, K. N. (1971) Airflow and turbulence noise for fricative and stop consonants, J. Acoust. Soc. Am. 50, 1180–1192; Shadle, C. (1985) The acoustics of fricative consonants, Research Laboratory of Electronics Technical Report 506, Massachusetts Institute of Technology, Cambridge Mass.). The factor Ka is arbitrary in the sense that AH is arbitrary; i.e., the KLSYN88 synthesizer uses a range of 0–70 dB for AH, with a value of 45 dB being typical for speech produced with a modal voice quality. For a given speaker, Ka can be calculated as the difference between the modal value of 45 dB and the noise level given by the term 20 log [(Ps−Pm)$^{3/2}$×ag$^{1/2}$] in equation (4). For example, for an open vocal tract (when (ac/ag) approaches infinity, and thus Pm=0) and for an average glottal area of 0.04 cm$^2$, $$Ka=45-20 \log [(8-0)^{3/2}(0.04)^{1/2}]=32 \text{ dB}. \quad (5)$$

Two other LL parameters, the amplitude of frication noise (AF) and the amplitude of voicing (AV), also depend on Pm and can be calculated by formulas as shown below, based on models of turbulence noise at constriction and models of vibrating vocal folds.

$$AF=20 \log [Pm^{3/2} \times ac^{1/2}]+st+Kf \quad (6)$$

$$AV=20 \log (Ps-Pm)^{3/2}+Kv-(ag-\text{modal width})=\text{Kdelta}\cdot AV \quad (7)$$

In equation (6) for AF, the scale factor Kf serves a function which is similar to that of the scale factor Ka in eq (4). The HL parameter st is included to account for the different effectiveness for noise generation of different obstacles in the airstream. Likewise in equation (7), the scale factor KV plays a similar role. Equation (7) is valid only when ag and Pm are within certain ranges within which glottal vibration occurs. These ranges are shown approximately in FIG. 7.

Equations (4), (6) and (7) (combined with equations (1), (2) and (3) for solving for Pm) illustrate the derivation of mapping relations between HL and LL parameters. These and other mapping relations between the HL parameters and the LL parameters will be understood by those of ordinary skill in the art with reference to the foregoing discussion. There may be a large number of suitable, non-unique, mapping relations for any combination of HL and LL parameters. The following summarizes one group of mapping relations that have been found to provide good results. The relations between the HL parameters and the other LL parameters were established by an analysis similar to that demonstrated above for AF, AH and AV. In some cases, a default value is used for the LL parameter. Theoretically, it is possible to replace some of the default values with a mapping relation based in part on the HL parameters. Some of these theoretical situations are indicated by noting that the LL parameter is a function of certain HL parameters, without specifying that function precisely.

SOURCE CALCULATIONS As used below, the notation f(x) means a function or relation of the parameter x LL parameter=expression with HL parameter $$F0 = \begin{cases} f0 & \text{, normally (vowels, etc.)} \\ \{f0+f(pm)+f(ac) & \text{, when } ag \text{ is in "voiced" range} \end{cases}$$

NUMERICALLY DETERMINED CONSTANTS

| | Male | Female |
|---|---|---|
| modal width = | .04 | .03 |
| Kv (constant of voicing) = | 33 | 33 |
| Ka (constant of aspiration) = | 33 | 33 |
| Kf (constant of frication) = | 27 | 27 |
| OQ def (default OQ) = | 50 | 60 |
| TL def (default TL) = | 5 | 7 |
| B1 def (default B1) = | 80 | 80 |
| KOQ (constant of OQ) = | 330 | 400 |
| KTL (constant of TL) = | 150 | 200 |
| KB1 (constant of B1) = | 4,000 | 4,400 |
| KdeltaAV (constant of deltaAV) = | 100 | 120 |

PARAMETERS FOR NASAL (an > 0)

F1 = f (ag, f1, f2, f3)
FNZ = f (ag, f1, f2, f3)
FNP = f (ag, f1, f2, f3)

-continued

B1 = f (ag, f1)
BNZ = f (ag, f1, f2)
BNP = f (ag, f1, f2)

The calculation of these parameters for nasal sounds involves application of the acoustic theory of nasals, as described by Fujimura (1962), Fujimura and Lindqvist (1971), and Stevens, Fant and Hawkins (1985). The poles FNP and F1 are determined by finding the frequencies for which the sum of the susceptances at the coupling point of the nasal passage and the vocal tract (FIG. 5*b*) is zero. It is noted that f1, f2, f3, f4 are the zeros of (Bp+Bm) in FIG. 5*b*. The zero FNZ is calculated by finding the frequencies for which the susceptances Bn and Bm in FIG. 5*b* are zero and determining an appropriate weighted sum of these frequencies. The bandwidths B1, BNP, and BNZ are determined from measured data on the acoustic losses in the vocal and nasal cavities.

CASCADE VOCAL TRACT PARAMETERS

F1 {= for an = 0, ag < 0.04 cm$^2$
{= as above for an > 0
{= f (ag, f1) for ag > 0.04 cm$^2$
B1 {= as above for an > 0
{= as above for ag > modal width
DF1 = default
DB1 = default
F2 = f2 } theoretically, f (f2, ac)
B2 = default } theoretically, f (f2, ac)
F3 = f3 } theoretically, f (f3, ac)
B3 = default } theoretically, f (f3, ac)
F4 = f4
B4 = default
F5–F8 = default (F6–F8 - only for SR > 10,000)
B5–B8 = default (B6–B8 - only for SR > 10,000)

TRACHEAL POLE and ZERO

FTP }
= f (ag, f1, f2)
BTP }
FTZ }
= f (ag, f1, f2)
BTZ }

The tracheal pole and zero are calculated following the methods outlined in Fant, G., K. Ishizaka, J. Lindqvist, and J. Sundberg (1972) Subglottal formants, Speech Transmission Lab. Quart. Progress and Status Rep. 1, Royal Institute of Technology, Stockholm, 85–107, and from experimental data given in Klatt and Klatt (1990).

PARLLEL BRANCH For fricative noise shaping, A2F, A3F, A4F, A5F, AB are calculated as functions of f2 and f3.

A6F=default

B2F through B6F=default (eventually, will be calculated in a manner similar to A2F, through A5F, above)

In a present implementation, the specification in terms of HL parameters of the following LL parameters is established: FO, AV, AH, AF, OQ, TL, B1, F1, F2, F3, F4, FNZ, FNP, A2F, A3F, A4F, A5F, AB. The following LL parameters are currently established by defaults, but theoretically they can be specified by mapping relations from HL parameters: B2, B3, BNZ, BNP, FTP, BTP, FTZ, BTZ and B2F, B3F, B4F, B5F and B6F. The following are specified by default values, and are expected to remain defaults: DF1, DB1; F5, F6, F7, F8, B5, B6, B7, B8 and A6F. No advantage would be achieved by deriving these from HL parameters.

Some examples of synthesis using HL parameters

In order to illustrate the control of the synthesizer by the higher-level parameters, the synthesis of four vowel-consonant-vowel (V-C-V) sequences is examined below. The vowel in each case is /a/, and the consonant in each sequence has the same place of articulation (alveolar, i.e., tip of tongue to behind top teeth) but different consonant manner (oral stop /t/, nasal stop /n/, fricatives /s/ and /z/) or consonant voicing (voiceless /t/ and /s/, voiced /n/ and /z/). These examples illustrate the relatively complex array of LL parameters that is needed for controlling the KLSYN88 synthesizer, and show that this control process is greatly simplified when the HL parameters are used.

EXAMPLE 1

Figure 8:
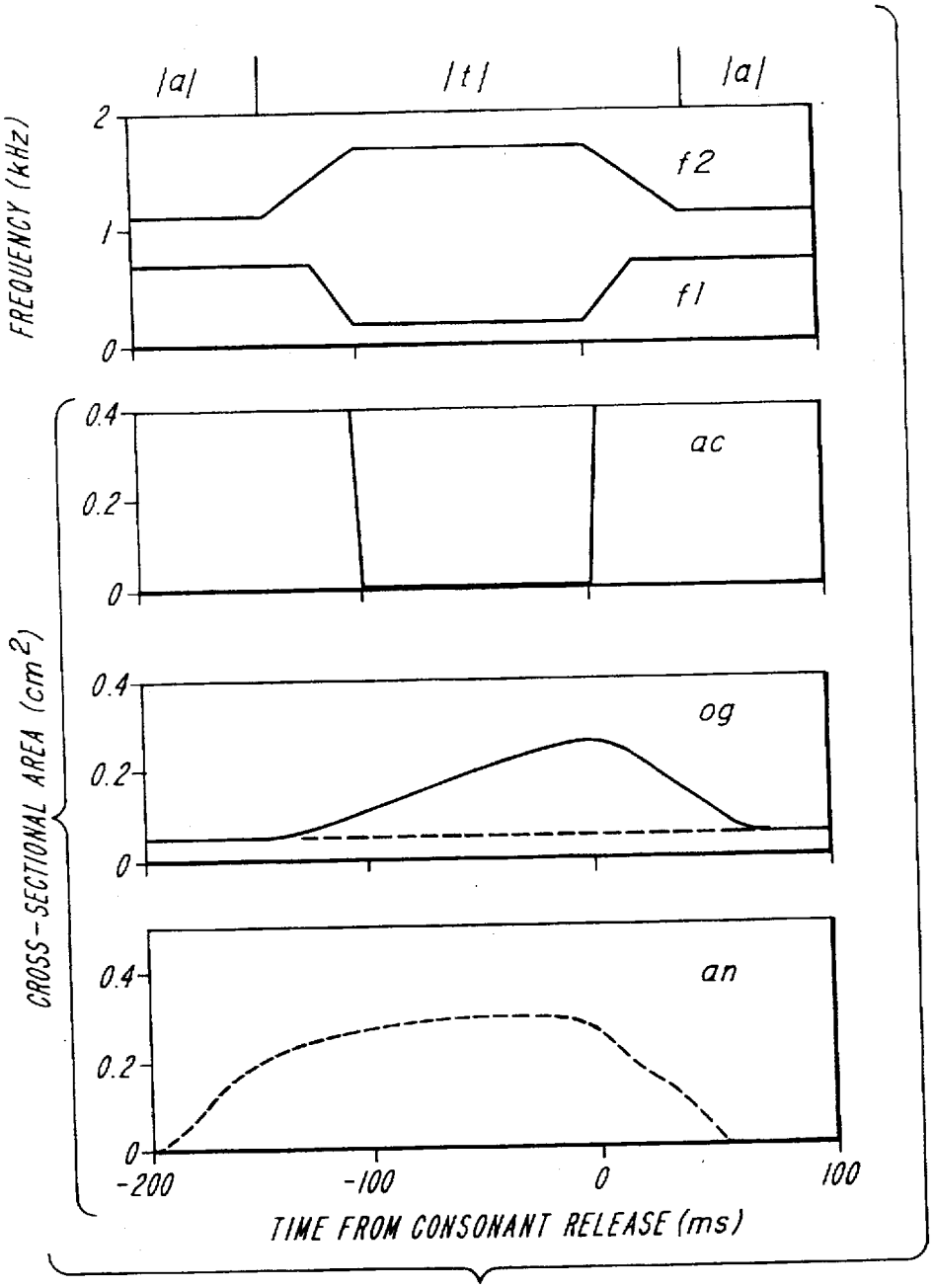
FIG. 8 shows schematically some of the HL parameters used to produce the utterances /at$^h$a/ and /ana/.

Five of the HL parameters needed to specify the voiceless aspirated stop consonant /t/ in the utterance [at$^h$a] are displayed in FIG. 8. The top panel of the figure shows the time course of the HL parameters f1 and f2 which represent the first two natural frequencies of the vocal tract. (The HL parameters f3 and f4 show only small movements for this utterance, and thus are not discussed here.) The f1 parameter has a rapid (about 20 msec) downward movement at the V-C transition (consonant implosion), and a similar upward movement at the C-V transition (consonant release). During the consonant closure interval, f1 is set at about 180 Hz—the measured natural frequency of the vocal tract with an alveolar constriction and glottal closure. The movements of f2 at these boundaries are somewhat slower than those of f1, as expected from theoretical considerations and from measurements. As is well known from data in the literature, the f2 endpoint frequency at either consonant boundaries is about 1700 Hz. The illustrated values for f2 and f1 were determined by analysis of recorded speech.

Like any stop consonant, /t/ is produced by making a complete closure of the vocal tract at the selected place of articulation, maintaining that closure for a few tens of milliseconds, and then releasing the closure. A plot of the HL parameter ac (cross-sectional area of a constriction in the closure of the vocal tract) against time is shown in the second panel in FIG. 8. The abrupt closure of the vocal tract is indicated by the rapid change in ac from about 0.4 cm$^2$ to 0. The rate of change of cross-sectional area at the consonant implosion and release has been taken to be about 100 cm$^2$/s.

The HL parameter ag, which represents the cross-sectional area of the glottal opening, is shown in the third panel of FIG. 8. Estimates of the time course of this parameter are based on several sources: (1) airflow data for this class of stop consonants, showing an increased average airflow at the end of the preceding vowel, and a peak of about 1200 cm$^2$/s immediately following the release, Klatt, D. H., Stevens, K. N. & Mead, J. (1966) *Studies of articulatory activity and air flow during speech*, Annals of the New York Academy of Sciences, 155, Art. 1, 42–55; (2) fiberoptic observations of the larynx or photoelectric glottography, Lofqvist, A. & Yoshioka, H. (1980) *Laryngeal activity in Swedish obstruent clusters*, Journal of the Acoustical Society of America, 68, 792–801; and (3) acoustic measurements of the change in the relative amplitudes of the first and second harmonics near the V-C and C-V boundaries indicating the offset and onset of breathy voicing at these boundaries. The glottal area, ag, begins to increase just before the consonant implosion, increases to a maximum of about 0.3 cm$^2$ just at the instant of the consonant release, and then returns to its value for modal vocal-fold vibration about 60 ms after the release. (The bottom panel of FIG. 8 pertains only to the utterance /ana/, discussed below.)

Figure 9:
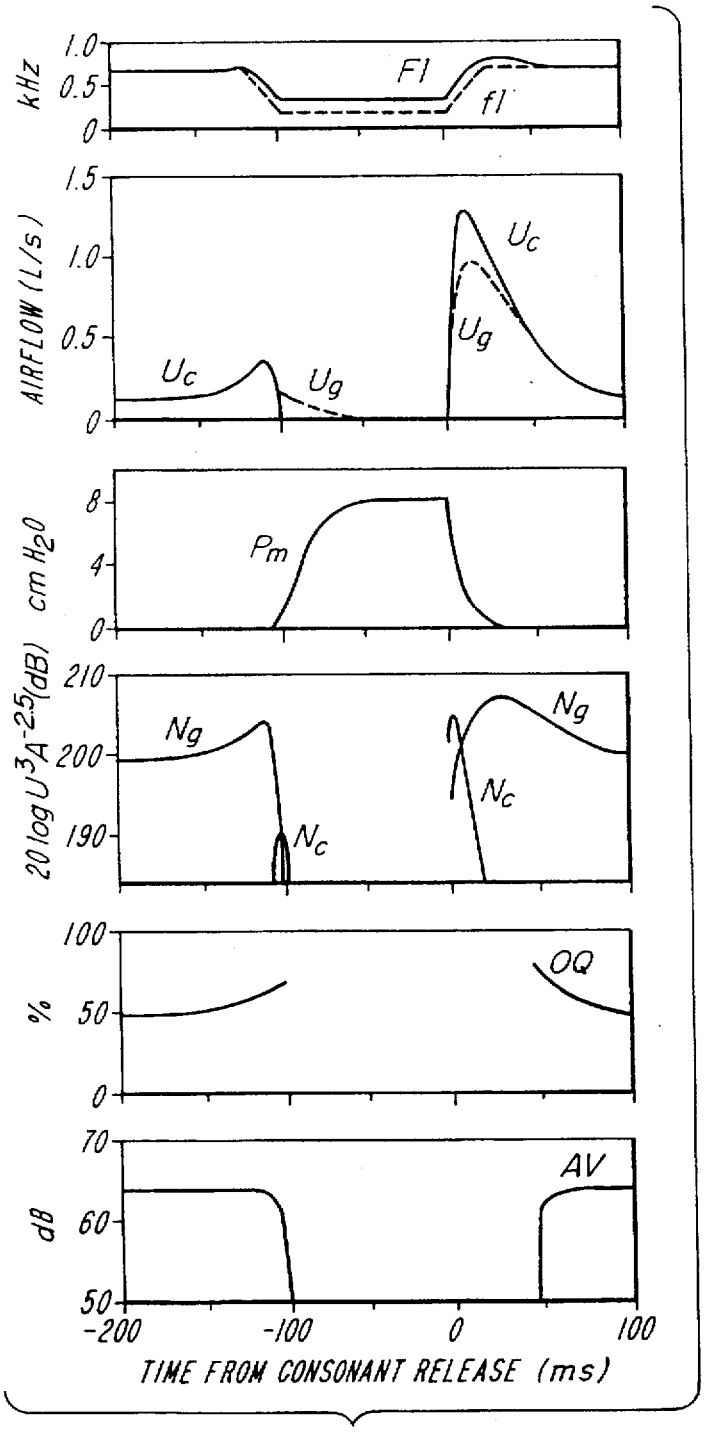
FIG. 9 shows schematically the generation of some of the LL parameters (and some intermediate parameters) corresponding to the HL parameters for the utterance /at$^h$a/ of FIG. 8.

The transformation from these HL parameters (f1, f2, ac, and ag) to the LL control parameters is discussed with respect to FIG. 9. This figure shows values for a few of the LL parameters, together with some intermediate aerodynamic variables which need to be determined in order to derive some of the LL parameters from the HL parameters.

The values of the LL parameter F1 is not the same as those for the HL parameter f1, because the spreading of the glottis at the consonant boundaries causes a raising of f1. This difference is shown in the top panel in FIG. 9, together with the original f1 parameter (dashed line).

The combination of the HL parameters ac and ag (together with an assumed subglottal pressure, e.g., 8 cm $H_2O$) applied in the formulas above leads to estimates of the airflow and intraoral pressure as a function of time, as shown in the second and third panels of FIG. 9. As mentioned above, the calculations of airflows and intraoral pressure use standard approximations for the relation between flow and pressure at a constriction Bickley, C. A. & Stevens, K. N. (1986) *Effects of vocal-tract construction on the glottal source: Experimental and modelling studies*; Journal of Phonetics, 14, 373–382, and take into account the yielding walls of the vocal tract.

Figure 7:
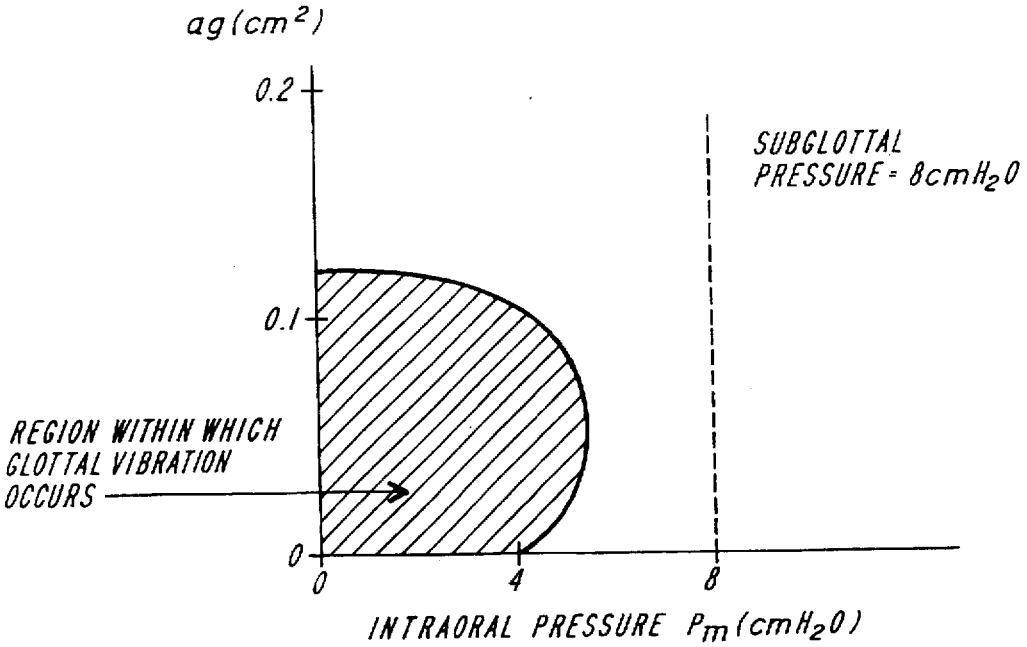
FIG. 7 is a schematic representation showing the relationship between the HL parameter ag and an intermediate expression Pm, with respect to glottal vibration.

From knowledge of the airflows, the mouth pressure, and cross-sectional areas of the glottal and supraglottal constrictions, estimates can be made of the amplitude and the spectrum of the turbulence noise sources at each of these locations, based on theoretical and experimental data on aerodynamic noise generation. These estimates are shown in the fourth panel of FIG. 9. The LL parameters giving the amplitudes AH of the aspiration noise source and AF of the frication noise source are derived directly from these estimates of intermediate source strength Ng and Nc (with a possible correction for stridency caused by the presence of obstacles or other surfaces, given by the HL parameter st, which will not be discussed here). The transglottal pressure (difference between subglottal and intraoral pressure) and the degree of glottal abduction (given by HL parameter ag) determine whether or not the vocal folds vibrate, as shown in FIG. 7. When glottal vibration occurs, these parameters can serve as the basis for making estimates of the LL control parameters that influence the waveform of the glottal source, particularly OQ (open quotient) and AV (amplitude of voicing). These estimates are given in the lower panels of FIG. 9, and are based on a model of vocal-fold vibration (Bickley, C. and K. N. Stevens (1986) Effect of a vocal tract constriction on the glottal source: experimental and modelling studies, Journal of Phonetics 14, 373–382), together with observations of vocal-fold activity under different conditions of transglottal pressure and glottal abduction.

Additional LL parameters not shown in FIG. 9 include B1 (bandwidth of the first formant, which is influenced by the glottal opening), TL (high-frequency spectral tilt), and gains (LL parameters: AB, A2F, A3F, A4F, A5F, A6F), and bandwidths (LL parameters: B2F, B3F, B4F, B5F, B6F) of the filters used to shape the frication noise. These parameter values can be determined from application of the other mapping relations set forth above.

EXAMPLE 2

As a second example, synthesis of the utterance [ana] is considered. Only a minor modification of the HL parameters shown in FIG. 8 is needed to produce the intervocalic alveolar nasal stop consonant /n/ rather than /t/. The shape of the supraglottal vocal tract (except for the velopharyngeal opening) changes in about the same way as it does when the consonant is a voiceless aspirated stop consonant, and consequently, the values of the HL parameters f1, f2 and ac are the same for the two utterances. In the case of the nasal consonant, however, the parameter ag remains essentially unchanged through the consonant (as shown by the dashed line in the third panel of FIG. 8), but values of the HL parameter an which represents the cross-sectional area of velopharyngeal opening, undergoes a change like that given in the bottom panel of FIG. 8. The exact time course of values for an is based in part on inferences from acoustical analyses of utterances of this kind. Data have shown some asymmetry in the nasalization at the implosion and the release of nasal consonants.

Figure 10:
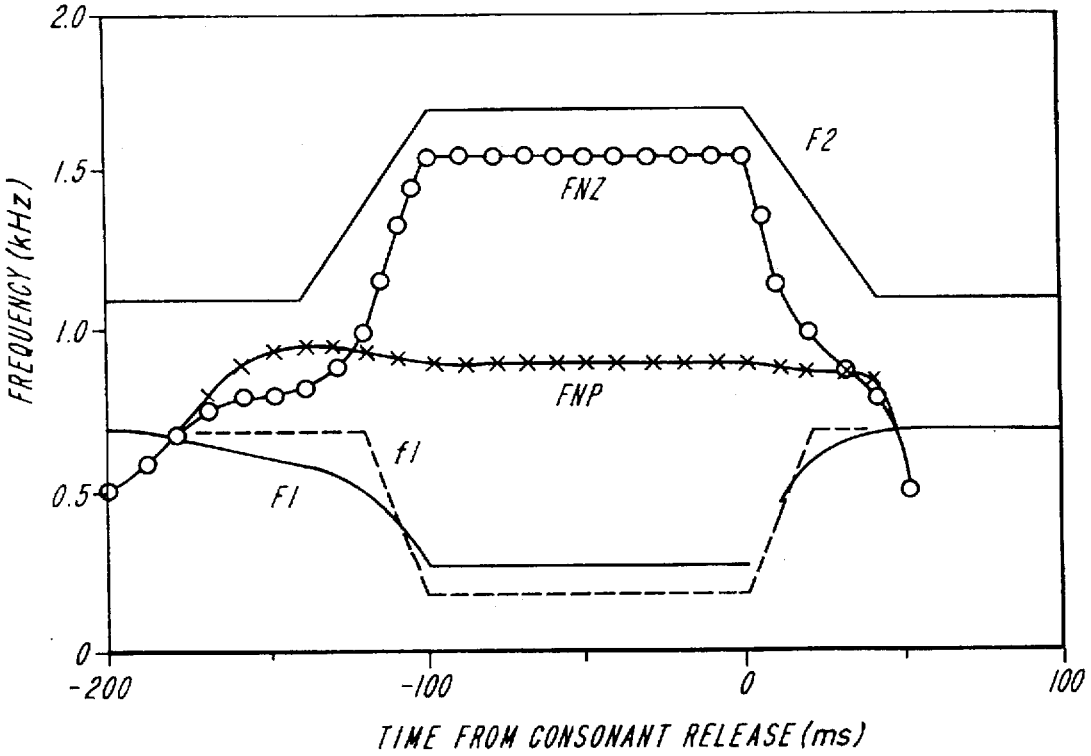
FIG. 10 shows schematically the generation of some of the LL parameters for the utterance /ana/.

The principal effect of the parameter an on the LL parameters is to create a first formant F1 that is modified relative to f1, and to introduce an additional pole and zero at frequencies FNP and FNZ (together with appropriate bandwidths BNP and BNZ). Plots of these LL parameters, as derived from HL parameters an, f1, and f2, are shown in FIG. 10. Estimates of these LL parameters are based on theoretical analysis of nasal vowels and consonants, and the theoretical analysis was guided somewhat by acoustic measurements. The F2 plot in FIG. 10 is identical to the HL parameter f2 in FIG. 8. Although it is recognized that nasalization will produce some small shifts in the second formant, these changes are neglected here. The trajectory of F1 is modified somewhat relative to the natural frequency f1 of the vocal tract, since nasalization produces a downward shift in the first formant for the low vowel /a/ (and an upward shift when f1 is low). During the nasal consonant, F1 is shifted upward relative to f1, and FNZ and FNP are at frequencies that can be calculated knowing the vocal-tract shape (Fujimura, 1962), as given by the frequencies f2, f3 and f4. The separation of FNZ and FNP in the time intervals between −170 and −100 ms, and between 0 and 30 ms provides the acoustic evidence for significant velopharyngeal opening. When the velopharyngeal opening is small (less than about 0.15 $cm^2$), FNP and FNZ are close together, indicating only a small acoustic effect of nasal coupling. The pole and zero cancel completely at a frequency of about 500 Hz, which is roughly the natural frequency of the nasal cavity with complete closure of the velopharyngeal port.

The first two examples of a voiceless aspirated (oral) stop consonant and a nasal stop consonant illustrate the contrast between controlling the synthesizer with HL parameters as opposed to LL parameters. Shifting from an oral to a nasal stop consonant with the same place of articulation involves a minor change in the HL parameters, but there are major changes in a large number of the LL parameters. Examples 3 and 4 expand upon this contrast between HL and LL parameters by demonstrating the comparatively simple changes in HL parameter values that are needed to change the oral stop consonant /t/ into the voiceless and voiced fricatives /s/ and /z/.

EXAMPLE 3

Figure 11A:
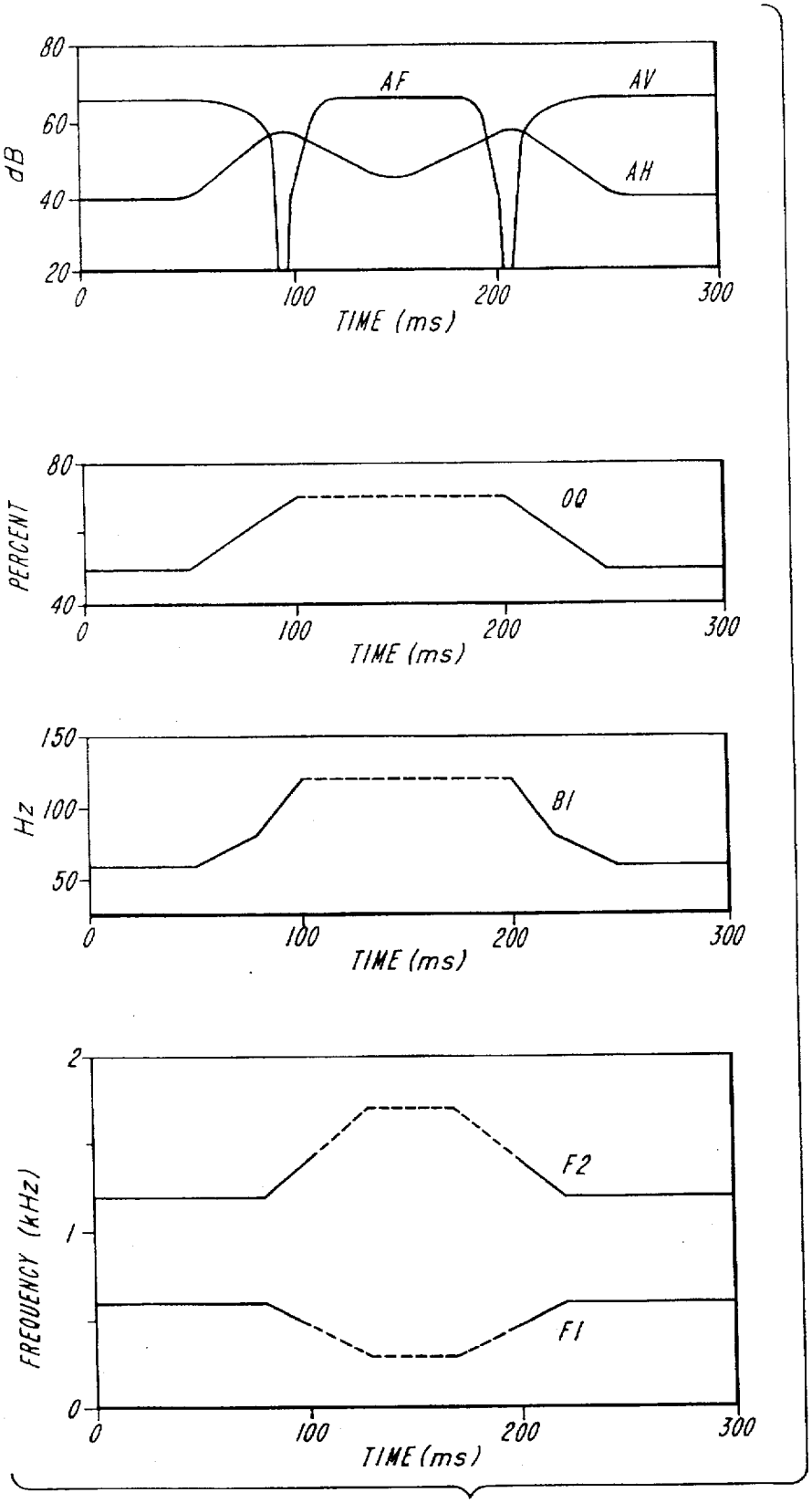
FIG. 11*a* shows schematically some of the LL parameters used to produce the utterances /asa/ and /aza/.

The simplification provided by the use of HL parameters can be further illustrated by comparing the array of LL and HL parameters needed to synthesize the utterances /asa/ and /aza/, as shown in FIGS. 11*a* (LL parameters) and 11*b* (HL parameters). A number of parameters have been omitted here in order to simplify the figure; these include parameters to shape the spectrum of the noise (A3F, A4F, and A5F) and to modify the high-frequency tilt of the glottal spectrum (TL).

In the top panel of Fig. 11*a*, abrupt changes are evident in the LL parameters AV (amplitude of voicing) and AF (amplitude of frication noise), which turn on and off rapidly at the consonant boundaries. The peaks in AH (amplitude of aspiration) and the increase in OQ (open quotient) and in B1 (first-formant bandwidth) near the boundaries reflect the breathy voicing that occurs near the edges of the vowels adjacent to the fricative. These three changes, as well as the decrease in AV, result from a change in glottal configuration. All of these parameters, including the formant parameters F1 and F2 in the bottom of the figure, must be carefully synchronized to produce the appropriate acoustic output, particularly the switching of the sources at the boundaries.

Figure 11B:
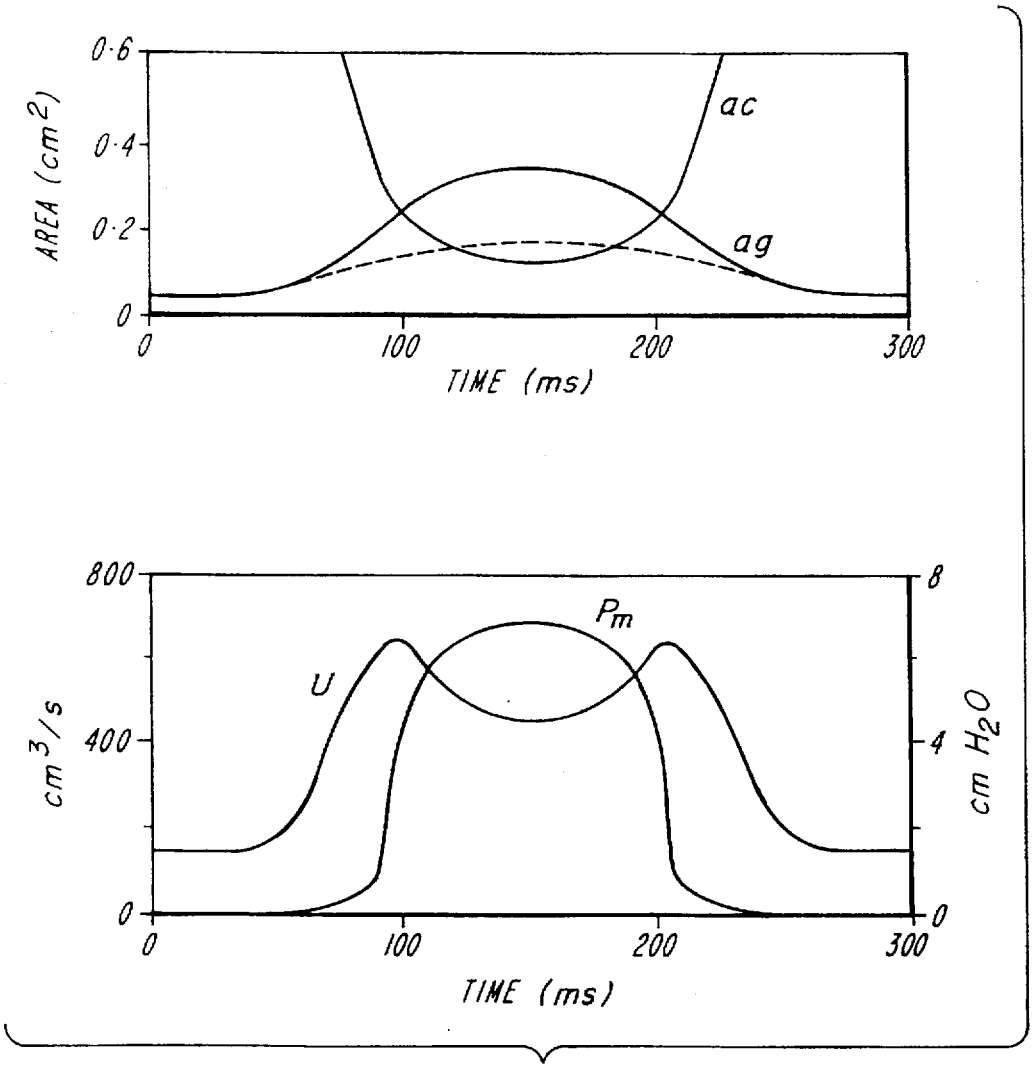
FIG. 11*b* shows schematically some of the HL and intermediate parameters used to produce the utterances /asa/ and /aza/.

The time variations of the HL parameters that control the synthesis of the utterance /asa/ are shown in Fig. 11*b*. The two most relevant parameters, ac and ag, are shown in the top panel of the figure. In order to produce the intervocalic fricative, a supraglottal constriction is formed, and, at the same time, the glottis is abducted. The glottal abduction is timed to begin before the supraglottal constriction is formed and extends beyond the release of the constriction. As can be shown, however, neither the precise value of ag during the frication interval nor the timing of the ag in relation to ac significantly affects the synthesized speech.

The transformation or mapping of the HL parameters to the LL parameters is based on known relations between vocal-tract shapes, aerodynamics, and acoustics, as has been shown above. The first step in this transformation is to calculate the intraoral pressure and the airflow through the glottis and through the supraglottal constriction. Knowing the airflow and the area, the next step is to calculate the amplitude of the turbulence noise source at the supraglottal constriction to yield the LL parameter AF. The glottal source parameters are calculated next, and these are based on models of sound generation at the vocal folds. When the transglottal pressure decreases below a threshold value (about 3 cm $H_2O$), vocal-fold vibration ceases, and turbulence noise becomes the predominant source at the glottis. The results of these calculations are the LL parameters AV, AH, and OQ. The bandwidth parameter B1 also is determined from calculation of losses at the abducted glottis. This example illustrates the dependence of several LL parameters (AV, AH, OQ, and B1) on one articulatory event (spreading of the glottis). In contrast, the HL parameters are more independent of each other.

EXAMPLE 4

As a final example, the voiceless fricative /s/ can be changed into the voiced fricative /z/ to produce the utterance /aza/. If synthesis is based on the HL parameters in Fig. 11*b*, then just one change is necessary: ag is modified so that only a small amount of abduction occurs during the fricative, as shown by the dashed line in the top panel of the figure. This single modification has several acoustic consequences that are taken care of by the HL-LL mapping relations: (1) the vocal folds continue to vibrate through all or part of the constricted interval; (2) the duration of the interval of frication noise decreases; (3) the durations of the vowel portions of the utterances are slightly longer; and (4) there is little or no evidence of breathy voicing at the vowel boundaries. If the LL parameters were used to produce the utterance /aza/, a number of changes would need to be made in the parameters in Fig. 11*a* in order to achieve the proper acoustic output.

The four examples presented here demonstrate the relative simplicity of synthesis specifications based on HL parameters relative to those based on LL parameters. In each example, far fewer HL parameters than LL parameters need to be specified. More importantly, only minor modifications must be made in order to change the HL parameter specification for one class of speech sounds into that for another. Thus, it is straightforward to modify the HL specification for the intervocalic oral stop consonant /t/ into a specification for the nasal stop consonant /n/, for the voiceless fricative /s/, and for the voiced fricative /z/. By contrast, many changes in the LL parameters are required to synthesize these different consonants, and the precise values and timing of these parameters is more critical. With proper implementation of the mapping relations between the two sets of parameters, the details of the variation of the LL parameters are taken care of automatically, and synthesis can be accomplished by manipulating just a few parameters that bear a close relation to well-understood, acoustically-relevant changes in vocal tract shape and in the laryngeal configuration.

One who possesses ordinary skill in the art will understand that synthesis of speech by any synthesizer, including a human speaker learning to speak a new language, is an iterative process. Initial attempts at synthesizing sounds are compared to the desired sound and adjustments are made. Thus, the mapping relations for synthesizing a specific sound, using HL parameters, must be established by an iterative process for each sound. Similarly, to specify the sound of a different speaker requires iterative analysis.

Thus, there is no closed form of the transformations from sound sequences to HL parameters, as set forth at element 202 in FIG. 4. The foregoing discussion will, however, enable one of ordinary skill in the art to develop such transformations for the speech sounds desired to be synthesized.

The foregoing description should be taken as illustrative and not limiting in any sense. As has been mentioned, rather than the specific set of HL parameters set forth in Table 1, a cognate set, as described, could be used. The invention may be used to specify or encode sound sequences in the HL parameters, and stored in this form. The invention may be used in conjunction with articulatory or terminal analogue synthesizers. The invention is also useful with synthesizers that are designed to accept HL parameters, thereby eliminating the need for LL parameters.

Having described the invention, what is claimed is:

1. A method for generating a signal corresponding to a sound sequence capable of being produced by a trachea and a vocal tract including a velopharyngeal port, a vocal fold, a glottal opening, and an intraoral cavity, said method comprising the steps of:

a. for each sound sequence, determining values of each of a plurality of high level parameters, said high level parameters consisting essentially of:

i. each of the first four natural frequencies of the vocal tract when the velopharyngeal port is closed and when there is no acoustic coupling between the vocal tract and the trachea;

ii. the fundamental frequency of vocal fold vibration;

iii. the area of glottal opening;

iv. the area of narrowest vocal tract constriction for consonants;

v. the cross-sectional area of the velopharyngeal port;

vi. a stridency parameter measuring the effectiveness of noise generation due to obstacles to air flow in the vocal tract; and vii. the change in intraoral pressure for obstruent consonants as a consequence of change in vocal tract volume;

b. deriving a plurality of low level parameters only from said high level parameters, by transforming said high level parameters using mapping relations into said low level parameters, the number of parameters in said plurality of low level parameters being at least twice the number of parameters in said plurality of high level parameters;

c. inputting said plurality of low level parameters into a speech synthesizer;

d. generating artificial speech from said plurality of low level parameters, said plurality of low level parameters being the only parameters required to generate said artificial speech.

2. The method of claim 1, wherein said signal represents acoustic energy and said low level parameters are input to a terminal analog synthesizer.

3. The method of claim 1, said low level parameters comprising:

a. a plurality of formant frequencies, bandwidths and time variations thereof;

b. a plurality of amplitudes and bandwidths of frication excited formants;

c. a plurality of parameters specifying the amplitudes and waveform characteristics of glottal sound sources;

d. amplitudes of voicing excited formants; and e. frequency and bandwidth of:

i) nasal poles and zeroes; and ii) tracheal poles and zeros.

4. The method of claim 1, wherein said signal represents acoustic energy and said low level parameters are input to an articulatory synthesizer.

5. A method for generating a signal corresponding to a sound capable of being produced by a trachea and a vocal tract including a velopharyngeal port, vocal folds, a glottal opening, and an intraoral cavity, said method comprising the steps of:

a. for each sound sequence, determining values of each of a plurality of high level parameters comprising:

i. the area of glottal opening;

ii. the area of narrowest vocal tract constriction for consonants;

iii. the cross-sectional area of the velopharyngeal port;

iv. a stridency parameter measuring the effectiveness of noise generation due to obstacles to air flow in the vocal tract; and v. the change in intraoral pressure for obstruent consonants as a consequence of change in vocal tract volume; and b. deriving a plurality of low level parameters only from said high level parameters, by transforming said high level parameters using mapping relations into said low level parameters, the number of parameters in said plurality of low level parameters being at least twice the number of parameters in said plurality of high level parameters;

c. inputting said plurality of low level parameters into a speech synthesizer;

d. generating artificial speech from said plurality of low level parameters, said plurality of low level parameters being the only parameters required to generate said artificial speech.

6. A method for the synthesis of speech in a terminal-analog speech synthesizer which is controlled by a set of greater than thirty control parameters, said method comprising the steps of:

specifying a set of values for ten or fewer input parameters which represent the speech to be synthesized, said set of ten or fewer input parameters including parameters representing frequencies of four resonances and cross-sectional areas of four constrictions of a vocal tract, said set of ten or fewer input parameters being the only parameters specified by the user of the synthesizer;

transforming said values for said set of ten or fewer input parameters into said set of greater than thirty control parameters using mapping relationships established for each of said set of greater than thirty control parameters;

applying said values for said set of greater than thirty control parameters to said speech synthesizer to synthesize human speech, said value for said set of greater than thirty control parameters being the only control parameters required to synthesize said human speech.

* * * * *